US008096814B2

(12) United States Patent
Schell et al.

(10) Patent No.: US 8,096,814 B2
(45) **Date of Patent: *Jan. 17, 2012**

(54) POWER CONNECTOR

(75) Inventors: Mark S. Schell, Palatine, IL (US); Edward Treece, Saxton, PA (US); Christopher Daily, Harrisburg, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/051,394

(22) Filed: Mar. 19, 2008

(65) Prior Publication Data

US 2008/0182439 A1 Jul. 31, 2008

Related U.S. Application Data

(60) Division of application No. 11/054,206, filed on Feb. 9, 2005, now Pat. No. 7,374,436, which is a continuation of application No. 09/944,266, filed on Aug. 31, 2001, now abandoned, which is a continuation-in-part of application No. 09/160,900, filed on Sep. 25, 1998, now Pat. No. 6,319,075.

(60) Provisional application No. 60/082,091, filed on Apr. 17, 1998.

(51) Int. Cl.
*H01R 12/00* (2006.01)

(52) U.S. Cl. ..... 439/79; 439/825

(58) Field of Classification Search ..... 439/79, 439/80, 825, 947

See application file for complete search history.

(56) References Cited

U.S. PATENT DOCUMENTS

| | | | | |
|---|---|---|---|---|
| 3,208,030 | A * | 9/1965 | Evans et al. | 439/290 |
| 3,420,087 | A | 1/1969 | Hatfield, J.G. et al. | 72/338 |
| 3,497,850 | A | 2/1970 | Gallo, Sr. | 337/197 |
| 3,750,092 | A | 7/1973 | Bury | 339/192 RL |
| 3,789,348 | A | 1/1974 | Lenaerts et al. | 339/198 R |
| 3,910,671 | A | 10/1975 | Townsend | 339/97 R |
| 3,944,312 | A | 3/1976 | Koenig | 339/59 R |
| 3,998,517 | A | 12/1976 | Griffin | |
| 4,005,923 | A | 2/1977 | Davis, Jr. | 439/651 |
| 4,073,564 | A | 2/1978 | Davis, Jr. | 439/651 |

(Continued)

FOREIGN PATENT DOCUMENTS

DE 23 50 834 4/1975

(Continued)

OTHER PUBLICATIONS

Molex Catalog# 870, Aug. 26, 1996, 2 pages. Cover and 77E.

(Continued)

*Primary Examiner* — Thanh Tam Le

(74) *Attorney, Agent, or Firm* — Woodcock Washburn LLP

(57) ABSTRACT

A pair of mating connectors includes a receptacle having an insulative housing and at least one conductive receptacle contact with a pair of spaced walls forming a plug contact receiving space. The plug connector has an insulative housing and at least one conductive contact having a pair of spaced walls which converge to form a projection engageable in the plug receiving space of the receptacle contact. The electronic power connectors can also be modified to accommodate connections for an external AC power supply. The connector housing incorporating the AC power connection capability can accommodate different forms of AC power supply termination contacts, such as spade-type contacts having a spring-like plug for receiving discrete quick connect socket terminals.

12 Claims, 30 Drawing Sheets

U.S. PATENT DOCUMENTS

| | | | | | |
|---|---|---|---|---|---|
| 4,227,762 | A | | 10/1980 | Scheiner | 339/91 R |
| 4,416,504 | A | * | 11/1983 | Sochor | 439/825 |
| 4,500,160 | A | | 2/1985 | Bertsch | 439/56 |
| 4,552,425 | A | * | 11/1985 | Billman | 439/295 |
| 4,603,930 | A | | 8/1986 | Ito | |
| 4,626,637 | A | | 12/1986 | Olsson et al. | 200/284 |
| 4,659,158 | A | | 4/1987 | Sakamoto et al. | 339/19 |
| 4,669,801 | A | | 6/1987 | Worth | 439/404 |
| 4,685,886 | A | * | 8/1987 | Denlinger et al. | 439/55 |
| 4,689,718 | A | | 8/1987 | Maue et al. | |
| 4,709,976 | A | | 12/1987 | Nakama et al. | 439/350 |
| 4,780,088 | A | | 10/1988 | Means | 439/107 |
| 4,790,763 | A | | 12/1988 | Weber et al. | 439/65 |
| 4,790,764 | A | | 12/1988 | Kawaguchi et al. | 439/78 |
| 4,815,987 | A | * | 3/1989 | Kawano et al. | 439/263 |
| 4,818,237 | A | * | 4/1989 | Weber | 439/693 |
| 4,820,169 | A | | 4/1989 | Weber et al. | 439/65 |
| 4,820,175 | A | | 4/1989 | Hasegawa et al. | 439/98 |
| 4,838,809 | A | | 6/1989 | Mouissie | 439/155 |
| 4,845,592 | A | | 7/1989 | Himes, Jr. et al. | 361/407 |
| 4,850,884 | A | | 7/1989 | Sawai et al. | |
| 4,867,696 | A | | 9/1989 | Demler et al. | |
| 4,869,676 | A | | 9/1989 | Demler, Jr. et al. | 439/79 |
| 4,875,865 | A | | 10/1989 | Demler et al. | 439/101 |
| 4,881,905 | A | | 11/1989 | Demler et al. | 439/79 |
| 4,889,501 | A | * | 12/1989 | Sato | 439/595 |
| 4,900,271 | A | | 2/1990 | Colleran et al. | 439/595 |
| 4,917,625 | A | | 4/1990 | Haile | 439/358 |
| 4,941,830 | A | | 7/1990 | Tkazyik et al. | 439/59 |
| 4,950,186 | A | | 8/1990 | Kaley et al. | 439/882 |
| 4,954,090 | A | | 9/1990 | Shimochi | 439/76 |
| 4,968,263 | A | | 11/1990 | Silbernagel et al. | 439/246 |
| 4,975,066 | A | | 12/1990 | Sucheski et al. | 439/63 |
| 4,975,084 | A | | 12/1990 | Fedder et al. | 439/608 |
| 5,035,639 | A | * | 7/1991 | Kilpatrick et al. | 439/290 |
| 5,046,960 | A | | 9/1991 | Fedder | 439/108 |
| 5,085,590 | A | | 2/1992 | Galloway | |
| 5,107,328 | A | | 4/1992 | Kinsman | 357/74 |
| 5,108,301 | A | | 4/1992 | Torok | 439/263 |
| 5,139,426 | A | | 8/1992 | Barkus | 439/65 |
| 5,152,700 | A | | 10/1992 | Bogursky et al. | 439/733 |
| 5,158,471 | A | | 10/1992 | Fedder et al. | 439/80 |
| 5,196,987 | A | | 3/1993 | Webber et al. | |
| 5,207,591 | A | | 5/1993 | Ozaki et al. | 439/212 |
| 5,213,518 | A | | 5/1993 | Weidler | |
| 5,281,168 | A | | 1/1994 | Krehbiel et al. | 435/595 |
| 5,295,843 | A | | 3/1994 | Davis et al. | 439/108 |
| 5,358,422 | A | | 10/1994 | Schaffer et al. | 439/346 |
| 5,362,249 | A | | 11/1994 | Carter | 439/79 |
| 5,376,012 | A | | 12/1994 | Clark | 439/80 |
| 5,403,206 | A | | 4/1995 | McNamara et al. | 439/608 |
| 5,403,210 | A | | 4/1995 | Hasegawa | |
| 5,435,876 | A | | 7/1995 | Alfaro et al. | 156/247 |
| 5,475,922 | A | * | 12/1995 | Tamura et al. | 29/881 |
| 5,478,244 | A | | 12/1995 | Maue et al. | |
| 5,503,565 | A | | 4/1996 | McCoy | |
| 5,549,480 | A | | 8/1996 | Cheng | 439/79 |
| 5,582,519 | A | | 12/1996 | Buchter | 439/101 |
| 5,590,463 | A | | 1/1997 | Feldman et al. | 29/844 |
| 5,605,489 | A | | 2/1997 | Gale et al. | 451/28 |
| 5,618,187 | A | | 4/1997 | Goto | 439/79 |
| 5,622,511 | A | | 4/1997 | Jarrett | 439/248 |
| 5,634,825 | A | * | 6/1997 | Maki | 439/745 |
| 5,643,013 | A | | 7/1997 | Weidler et al. | 439/660 |
| 5,664,969 | A | * | 9/1997 | Peterson et al. | 439/746 |
| 5,667,392 | A | | 9/1997 | Kocher et al. | 439/79 |
| 5,702,257 | A | | 12/1997 | Millhimes | 439/79 |
| 5,716,234 | A | | 2/1998 | Phillips | 439/595 |
| 5,785,557 | A | | 7/1998 | Davis | 439/660 |
| 5,797,770 | A | | 8/1998 | Davis et al. | 439/607 |
| 5,823,798 | A | | 10/1998 | Zintler et al. | |
| 5,865,651 | A | | 2/1999 | Dague et al. | 439/680 |
| 5,872,046 | A | | 2/1999 | Kaeriyama et al. | 438/465 |
| 5,882,231 | A | | 3/1999 | Takano et al. | |
| 5,904,594 | A | | 5/1999 | Longueville et al. | 439/608 |
| 5,923,995 | A | | 7/1999 | Kao et al. | 438/460 |
| 5,924,899 | A | | 7/1999 | Paagman | 439/701 |
| 5,937,140 | A | | 8/1999 | Leonard et al. | 392/392 |
| 5,997,347 | A | | 12/1999 | Robinson et al. | 439/517 |
| 5,997,363 | A | * | 12/1999 | Joly | 439/748 |
| 6,027,360 | A | | 2/2000 | Jenkins | 439/364 |
| 6,062,911 | A | | 5/2000 | Davis et al. | 439/630 |
| 6,063,696 | A | | 5/2000 | Brenner et al. | 438/465 |
| 6,109,981 | A | | 8/2000 | Jin-ichi et al. | 439/733.1 |
| 6,171,140 | B1 | | 1/2001 | Anbo et al. | |
| 6,178,106 | B1 | | 1/2001 | Umemoto et al. | 363/146 |
| 6,190,215 | B1 | | 2/2001 | Pendleton et al. | 439/853 |
| 6,319,075 | B1 | | 11/2001 | Clark et al. | |
| 6,335,224 | B1 | | 1/2002 | Peterson et al. | 438/114 |
| 6,358,067 | B1 | | 3/2002 | Takase | |
| 6,358,094 | B1 | | 3/2002 | Belopolsky et al. | 439/637 |
| 6,361,375 | B1 | | 3/2002 | Sinclair | |
| 6,394,818 | B1 | | 5/2002 | Smalley, Jr. | |
| 6,402,566 | B1 | | 6/2002 | Middlehurst et al. | 439/699.1 |
| 6,471,523 | B1 | | 10/2002 | Shuey | 439/63 |
| 6,848,953 | B2 | | 2/2005 | Schell et al. | 439/825 |
| 6,869,294 | B2 | | 3/2005 | Clark et al. | |
| 7,059,919 | B2 | | 6/2006 | Clark et al. | |
| 7,374,436 | B2 | * | 5/2008 | Schell et al. | 439/79 |

FOREIGN PATENT DOCUMENTS

| | | | |
|---|---|---|---|
| DE | 34 41 416 | A1 | 5/1986 |
| DE | 40 01 104 | A1 | 7/1991 |
| EP | 0 465 013 | | 1/1992 |
| EP | 0 623 248 | B2 | 11/1995 |
| EP | 0623 248 | B1 | 11/1995 |
| EP | 0 724 313 | | 7/1996 |
| EP | 0 951 102 | A2 | 10/1999 |
| FR | 2 699 744 | | 6/1994 |
| GB | 2168550 | | 6/1986 |
| JP | 09 055 245 | | 2/1997 |
| WO | WO 93/15532 | | 8/1993 |
| WO | WO 00/16445 | | 3/2000 |

OTHER PUBLICATIONS

Male Crimp Terminal, (10-12, AWG) Mini-Fit, Sr Series, Jul. 25, 1991, 1 page, X-42817.

FCI, "PwrBlade™ Power Distribution Connector System," 2003, www.fciconnecct.com. 2 pages.

FCI, "PwrBlade™ Power Distribution Connector System," *Technology Innovation Service*, 2003, 2-3.

FCI, "PwrBlade™ new Power Distribution Connecctor For Electronic Applications," *Product News*, 2003, www.fciconnect.com, 1 page.

FCI, "Act Connectors in Action," *Panorama*, 2003, 1 page.

* cited by examiner

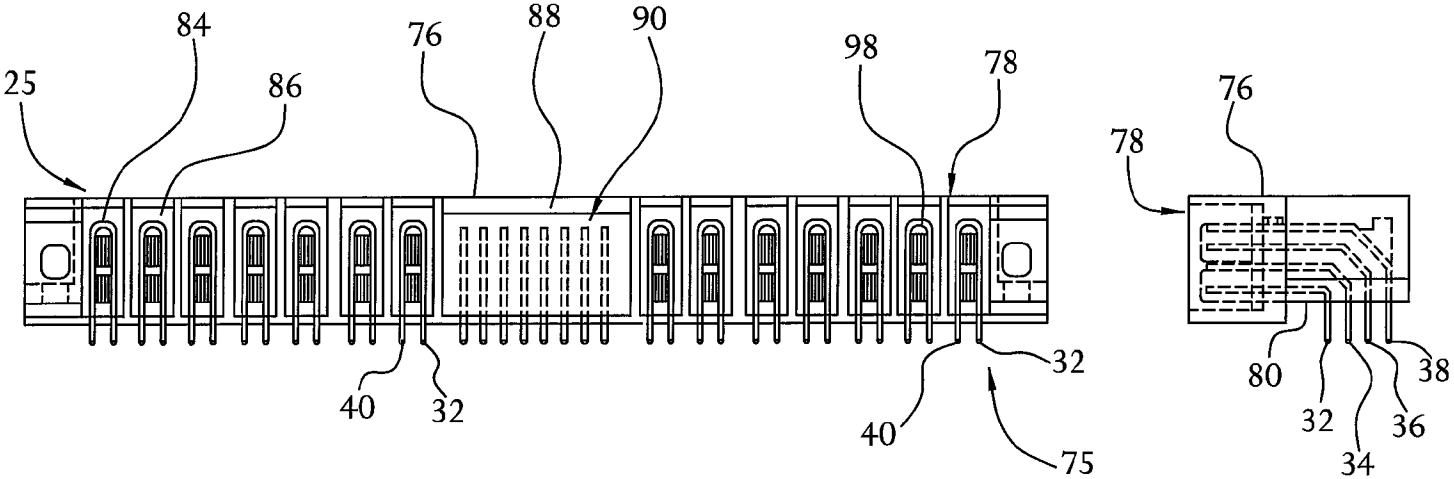
FIG. 7
FIG. 5
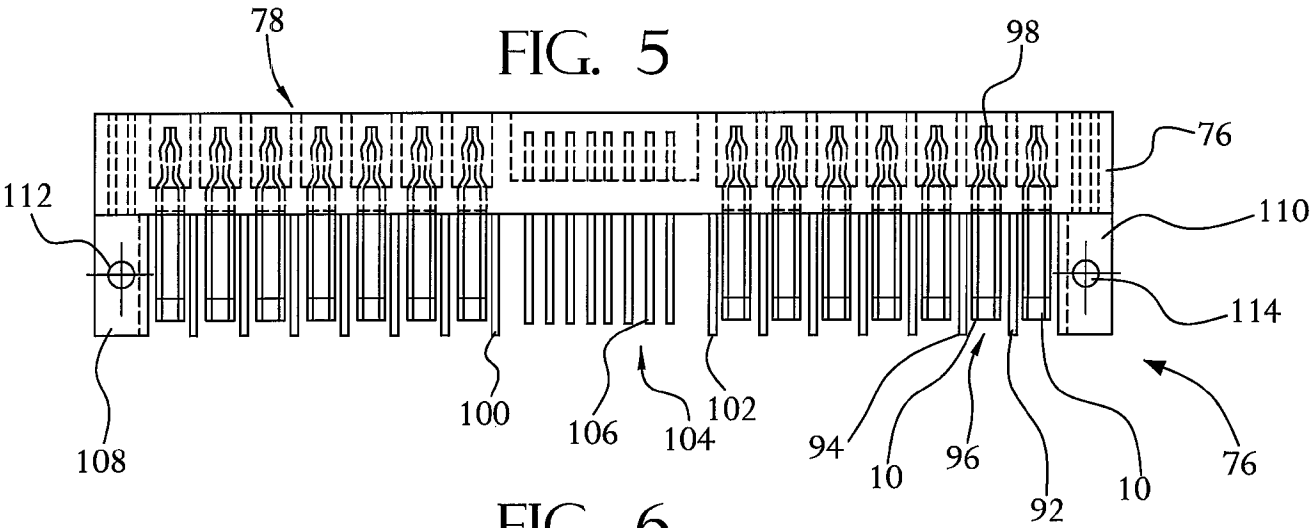
FIG. 6

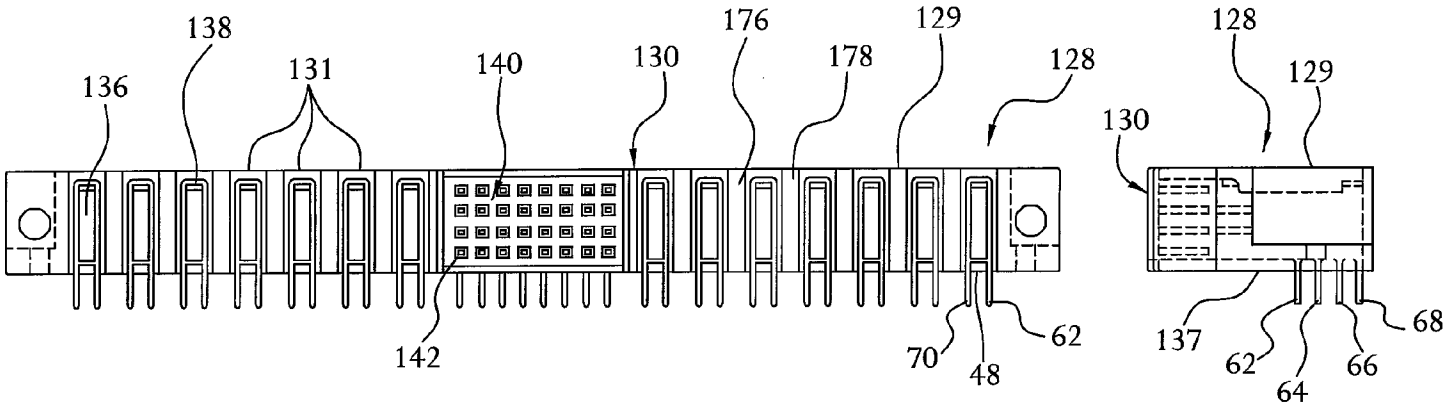
FIG. 10
FIG. 12
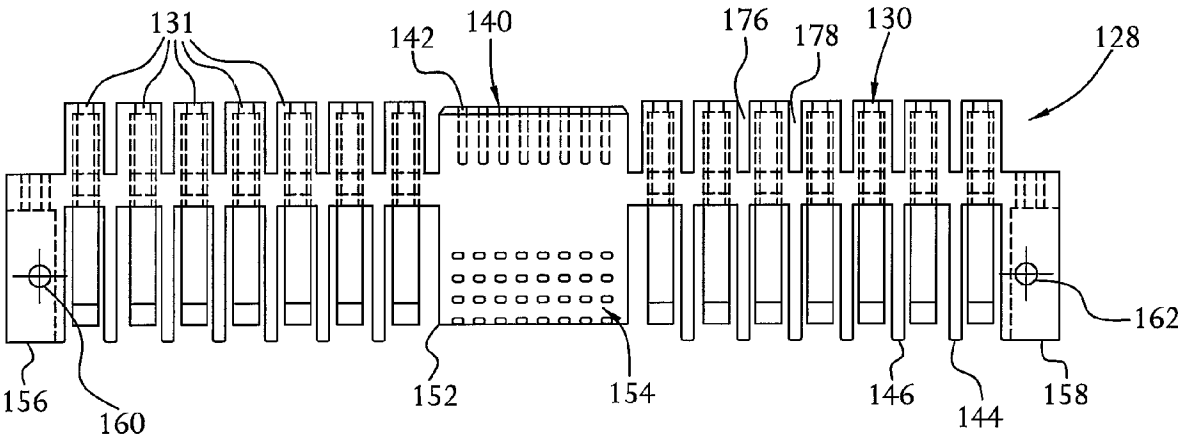
FIG. 11

POWER CONNECTOR

CROSS REFERENCE TO RELATED APPLICATIONS

This is a divisional of U.S. application Ser. No. 11/054,206, filed on Feb. 9, 2005, which is a continuation of U.S. application Ser. No. 09/944,266, filed on Aug. 31, 2001, now abandoned, which is a continuation-in-part of U.S. application Ser. No. 09/160,900, filed on Sep. 25, 1998, now U.S. Pat. No. 6,319,075, which claims the benefit of Provisional Application No. 60/082,091, filed Apr. 17, 1998, the contents of all of which are incorporated by reference herein.

FIELD OF THE INVENTION

The present invention relates to electrical connectors and more particularly to electronic power connectors especially useful in circuit board or backplane interconnection systems.

BACKGROUND OF THE INVENTION

Designers of electronic circuits generally are concerned with two basic circuit portions, the logic or signal portion and the power portion. In designing logic circuits, the designer usually does not have to take into account any changes in electrical properties, such as resistance of circuit components, that are brought about by changes in conditions, such as temperature, because current flows in logic circuits are usually relatively low. However, power circuits can undergo changes in electrical properties because of the relatively high current flows, for example, on the order of 30 amps or more in certain electronic equipment. Consequently, connectors designed for use in power circuits must be capable of dissipating heat (generated primarily as a result of the Joule effect) so that changes in circuit characteristics as a result of changing current flow are minimized. Conventional plug contacts in circuit board electrical power connectors are generally of rectangular (blade-like) or circular (pin-like) cross-section. These are so-called "singular-mass" designs. In these conventional singular-mass blade and pin configurations, the opposing receptacle contacts comprise a pair of inwardly urged cantilever beams and the mating blade or pin is located between the pair of beams. Such arrangements are difficult to reduce in size without adversely effecting heat dissipation capabilities. They also provide only minimal flexibility to change contact normal forces by adjustment of contact geometry. There is a need for a small contact which efficiently dissipates heat and which has readily modifiable contact normal forces.

In the parent application for the present application, namely U.S. patent application Ser. No. 09/160/900, electronic power connectors are described for use in power circuits where the connectors provide terminations associated with power that is internal to the system. In some power circuit configurations an external power supply, usually an external AC power cable, may also be incorporated into the overall environment. The external AC power supply connections are known to be stand-alone cable connections that are terminated directly onto the board. This poses known drawbacks due to the fact that in those circumstances where the AC power supply is on the order of 30 amps or more an undesirable level of heat buildup on the traces of the power board can occur. Also, where stand-alone cable connections are used to adapt AC power by direct wire termination onto the power distribution boards there is an additional level of complexity in the connective configurations on the board. Thus, there is a need for an electronic power connector that incorporates into a single housing those contacts for establishing connections for the internal system power and contacts for mating with an external power cable.

SUMMARY OF THE INVENTION

The present invention relates to electrical connectors that comprise a receptacle having an insulative housing and at least one conductive receptacle contact comprising a pair of spaced walls forming a plug contact receiving space. A mating plug comprises an insulative housing and at least one conductive contact having a pair of spaced walls which form a projection engageable in the plug receiving space of the receptacle contact. The contacts employ a "dual mass" principle that provides a greater surface area available for heat dissipation, principally by convection, as compared with "single-mass" contacts. This arrangement provides an airflow path through spaced portions of the contacts of the plug and receptacle connectors when mated.

Also, an electrical power connector is described herein that incorporates contacts for establishing AC power cable connections into a single housing along with the power connector contacts that are otherwise described herein. Incorporation of AC power cable connections directly into the insulative housing that forms the internal power connector eliminates the need for any transitional type, stand-alone AC power supply connection system such as that described above. The connector housing incorporating the AC power connection capability can accommodate different forms of AC power supply termination contacts, such as spade-type contacts for receiving discrete fast-on terminals or contacts described herein for connection to bus bars.

BRIEF DESCRIPTION OF THE DRAWINGS

The present invention is further described with reference to the accompanying drawings in which:

FIG. 5 is a front elevational view of a plug connector;

FIG. 6 is a top plan view of the plug connector shown in FIG. 5;

FIG. 7 is an end view of the plug connector shown in FIG. 5;

FIG. 10 is a front elevational view of a receptacle connector;

FIG. 11 is a top plan view of the receptacle connector shown in FIG. 10;

FIG. 12 is an end view of the receptacle connector shown in FIG. 10;

DETAILED DESCRIPTION OF ILLUSTRATIVE EMBODIMENTS

Figure 1:
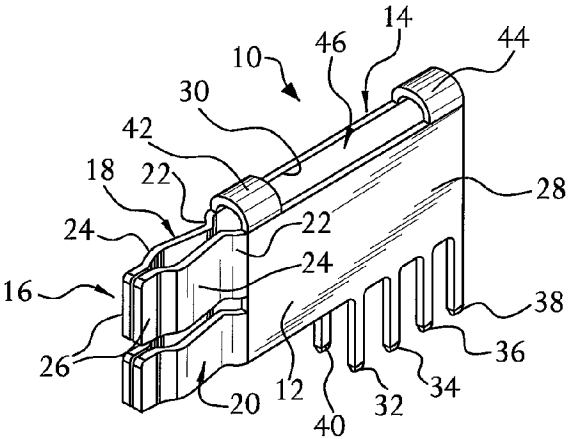
FIG. 1 is a perspective view of a plug contact.
Figure 2:
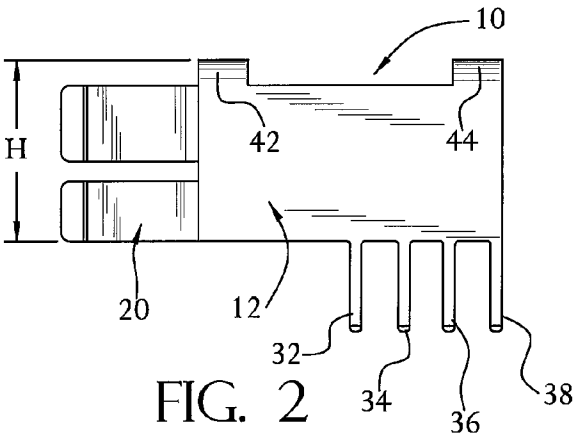
FIG. 2 is a side elevational view of the plug contact shown in FIG. 1.

Referring to FIGS. 1 and 2, a plug contact 10 for use in a plug connector is shown. This plug contact has two opposed major side walls 12 and 14. A front projection, identified generally by numeral 16, has an upper section 18 and a lower section 20. Each of these upper and lower sections comprises a pair of opposed cantilever beams, each beam having inwardly converging proximal section 22, arcuate contact section 24 and a distal section 26. The opposed distal sections 26 are preferably parallel to each other. The distal sections can be positioned slightly apart when the beams are in relaxed condition, but come together when the beams are deflected as the front projection is inserted into a receptacle contact (as explained below). This provides over-stress protection for the beams during mating. The side walls also include planar panels 28 and 30. Terminals 32, 34, 36 and 38 extend from an edge of panel 28. Terminal 40 extends from panel 30, along with a plurality of like terminals (not shown). Terminals 32-40 can comprise through hole, solder-to-board pins (as shown), press fit pins or surface mount tails. The panels 28 and 30 are connected by upper arcuate bridging elements 42 and 44. A medial space 46, adapted for airflow, is defined between the panels 28 and 30. The contact 10 is stamped or otherwise formed as a single piece from a strip of suitable contact materials such as phosphor bronze alloys or beryllium copper alloys.

Figure 3:
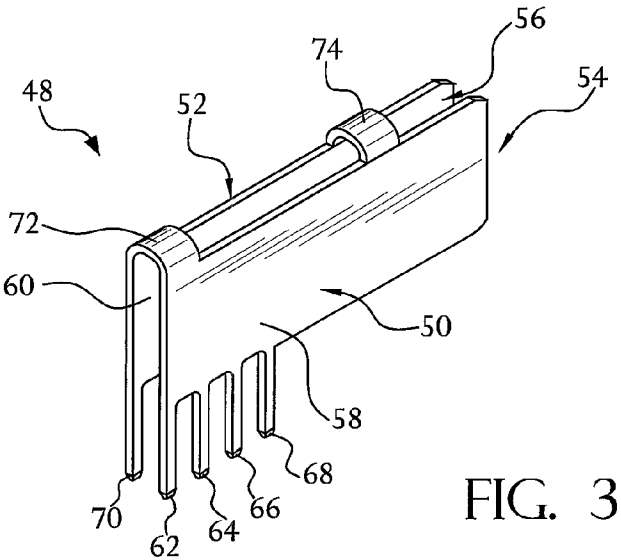
FIG. 3 is a perspective view of a receptacle contact.
Figure 4:
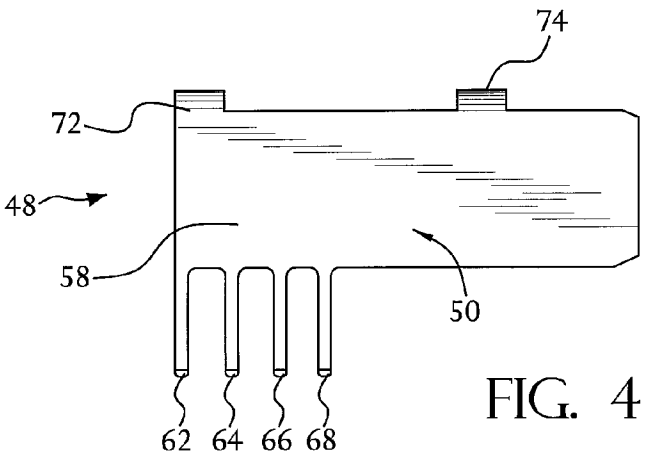
FIG. 4 is a side elevational view of the receptacle contact shown in FIG. 3.
Figure 8:
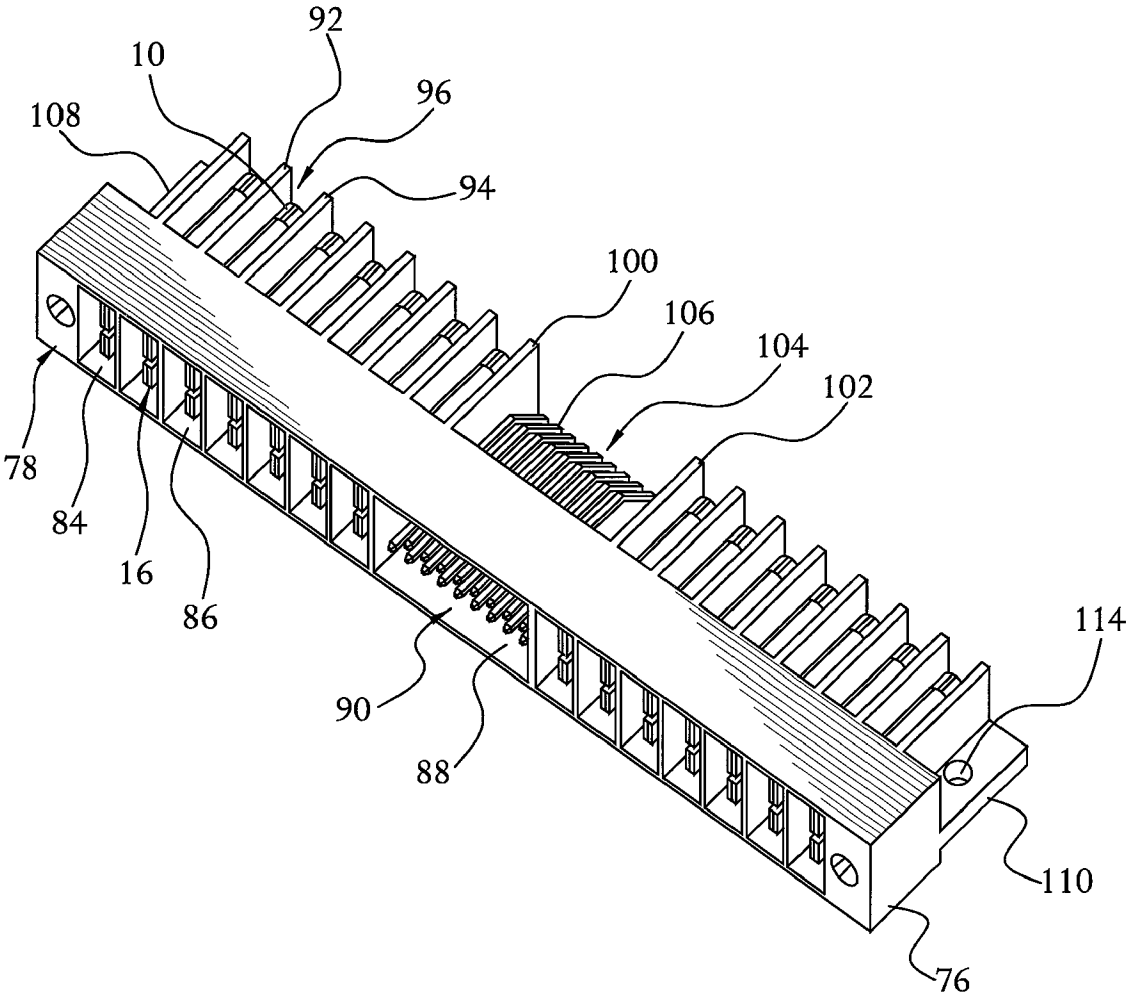
FIG. 8 is a top front perspective view of the plug connector shown in FIG. 5.
Figure 9:
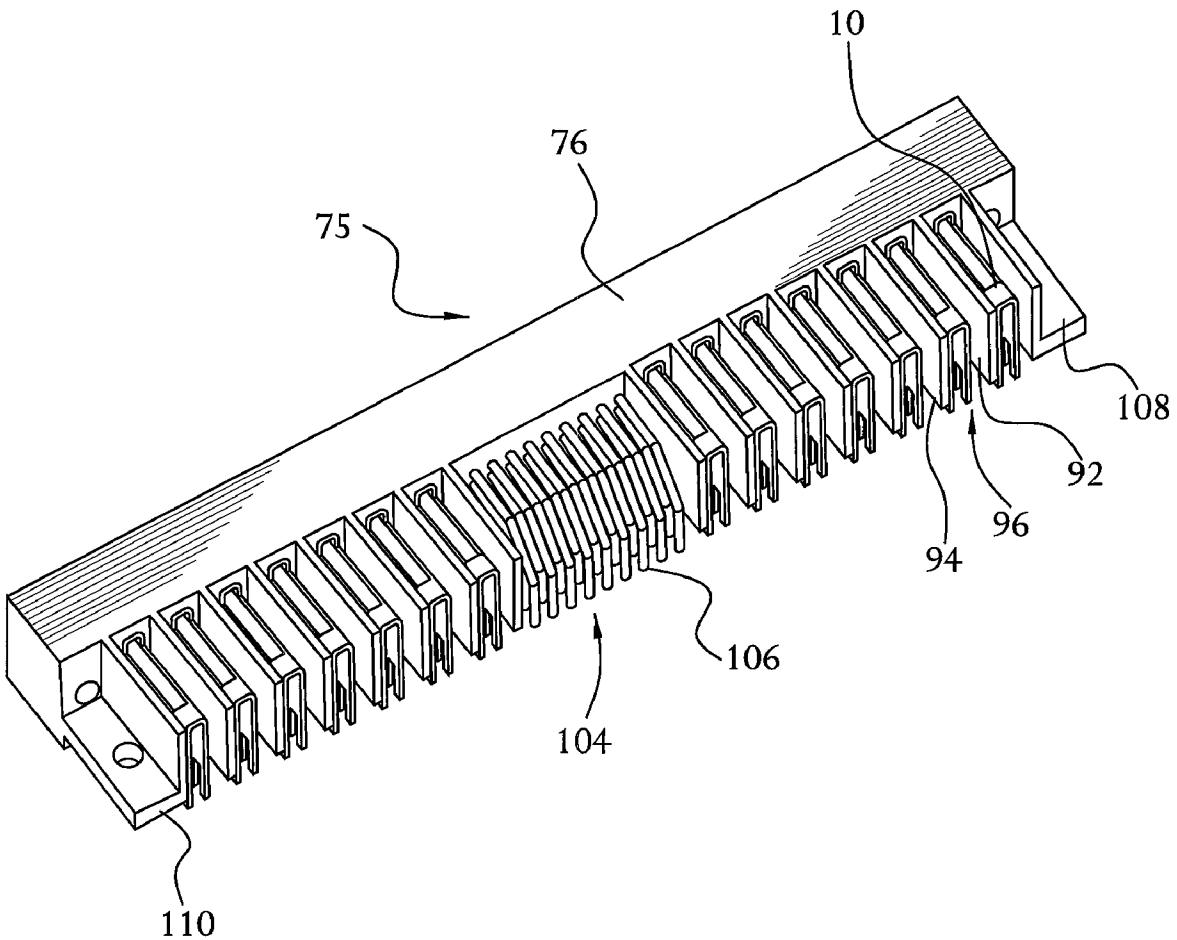
FIG. 9 is a top rear perspective view of the plug connector shown in FIG. 5.
Figure 13:
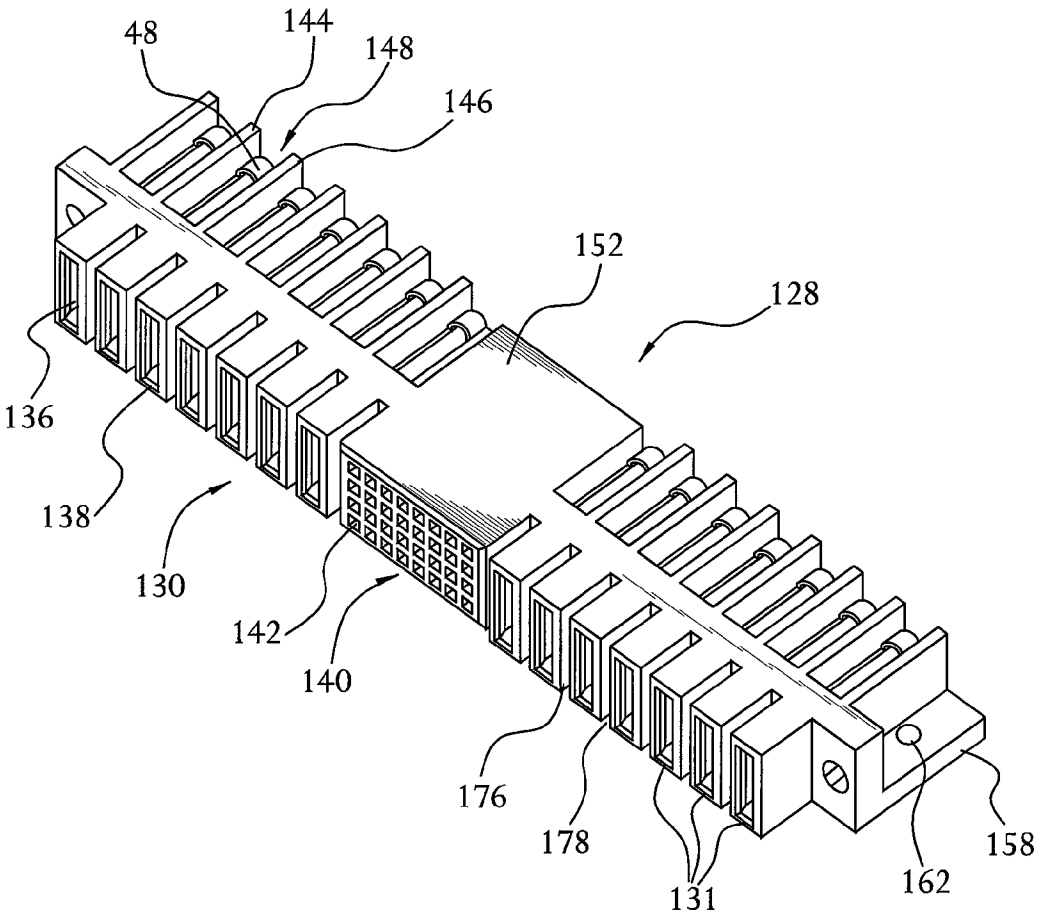
FIG. 13 is a top front perspective view of the receptacle connector shown in FIG. 10.
Figure 14:
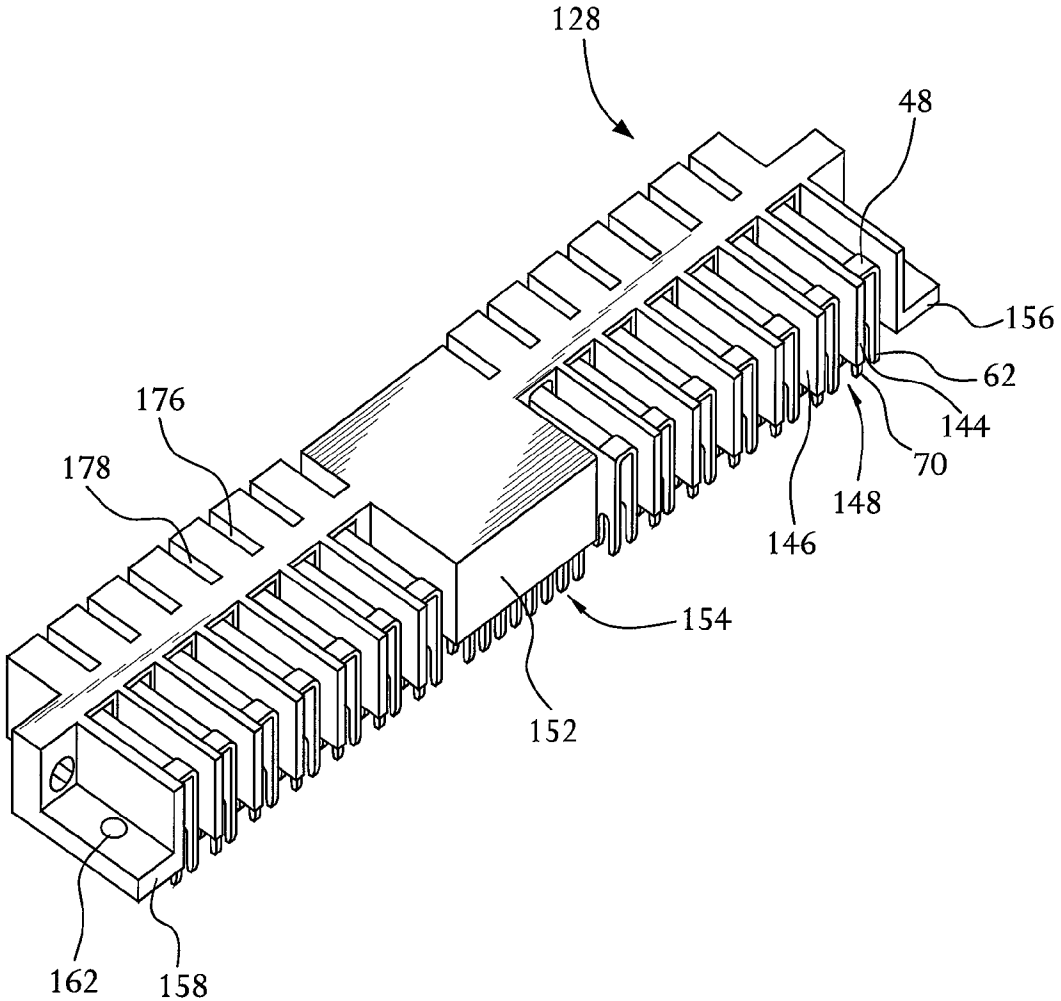
FIG. 14 is a top rear perspective view other receptacle connector shown in FIG. 1.

Referring to FIGS. 3 and 4, receptacle contact 48 is shown. This receptacle contact has opposed, preferably planar and parallel side walls 50 and 52. These walls extend forwardly in a front projecting portion 54, that forms a medial plug receiving space 56. The distance between walls 50 and 52 at portion 54 is such that the projection 16 of the plug contact 10 is receivable in the plug contact receiving space 56, with the beams being resiliently deflected toward the center plane of contact 10. The deflection causes the beams to develop outwardly directed forces, thereby pressing the arcuate portions 24 against the inside surfaces of the portions 54 forming the receiving space 56, to develop suitable contact normal force. The side walls 50 and 52 also include, respectively, panels 58 and 60. Extending from panel 58 there are terminals 62, 64, 66 and 68. Extending from panel 60 there is terminal 70 as well as several other terminals (not shown). These terminals are essentially the same as previously described terminals 32-40. The side walls 50 and 52 are joined together by generally arcuate bridging elements 72 and 74. Preferably, the receptacle contact is also stamped or otherwise formed in a single piece from a strip of phosphor bronze alloy or beryllium copper alloy.

FIGS. 5-9 illustrate a plug connector 75 having an insulative plug housing 76. The housing 76 includes a front side 78 having a plurality of power contact apertures 84 and 86. The front projection or mating portion 16 (FIGS. 1 and 2) of the plug contacts is disposed in apertures 84, 86. The plug contacts 10 are retained in the housing 76 by an interference fit between the contact and the housing. This is accomplished by having the dimension H (FIG. 2), the dimension between bottom edge of wall 12 and the top of bridging element 42, slightly greater than the dimension of the cavity in housing 76 that receives this portion of plug contact 10. The front side 78 may also include a signal pin array opening 88 for housing a signal pin array designated generally as numeral 90. The housing 76 also includes a number of rear vertical partitions, such as partitions 92 and 94, which form power contact retaining slots 96 for housing the plug contacts 98. The opposed medial vertical partitions 100 and 102 form between them a rear signal pin array space 104 for housing the rear portion 106 of the signal pins. The housing 76 also includes opposed rear mounting brackets 108 and 110 which have respectively mounting apertures 112 and 114. The plug contacts 10 have terminals 32, 34, 36, 38 and 40 extending below a bottom edge 80 of housing 76. The edge 80 forms a mounting interface, along which the housing is mounted to a printed circuit board or other structure on which the connector is mounted.

Referring to FIGS. 10-14, a receptacle connector 128 is shown. Receptacle 128 has an insulative housing 129 with a front side 130 including a plurality of silos 131 having contact openings, such as openings 136 and 138. The front side 130 forms a mating interface of the connector 128 for mating with plug connector 75. The silos 131 are configured and sized to be received in openings 84, 86 of connector 75. The front portions 54 (FIGS. 3-4) of the receptacle contacts are disposed within silos 131 and openings 134, 136 are sized and configured to receive the upper and lower sections 18 and 20 of plug contacts 10. The front side 130 has a signal pin receiving area 140 with signal pin receiving apertures. The housing 129 also has a plurality of rear partitions, such as partitions 144 and 146, which form contact retaining slots 148 for housing receptacle contacts 48. Signal pin housing 152 receives a signal receptacle contact array 154. The housing 129 also includes opposed rear mounting brackets 156 and 158 which have, respectively, mounting apertures 160 and 162. The receptacle contact terminals 62, 64, 66, 68 and 70 extend beneath surface 137, that forms the mounting interface of receptacle connector 128. The front side 130 of the housing 128 also has a plurality of vertical spaces 176 and 178, disposed between silos 131.

The receptacle contacts 48 are retained in housing 129 by an interference fit in essentially the same manner as previously described with respect to plug contacts 10. Retaining the contacts in this fashion allows substantial portions of the walls 12, 14 of the plug contact and walls 58, 60 of the receptacle contact to be spaced from surrounding parts of the respective housings 76 and 129. This leaves a substantial proportion of the surface area of both contacts (including the plug contacts), exposed to air, thereby enhancing heat dissipation capabilities, principally through convection. Such enhanced heat dissipation capabilities are desirable for power contacts.

Figure 15:
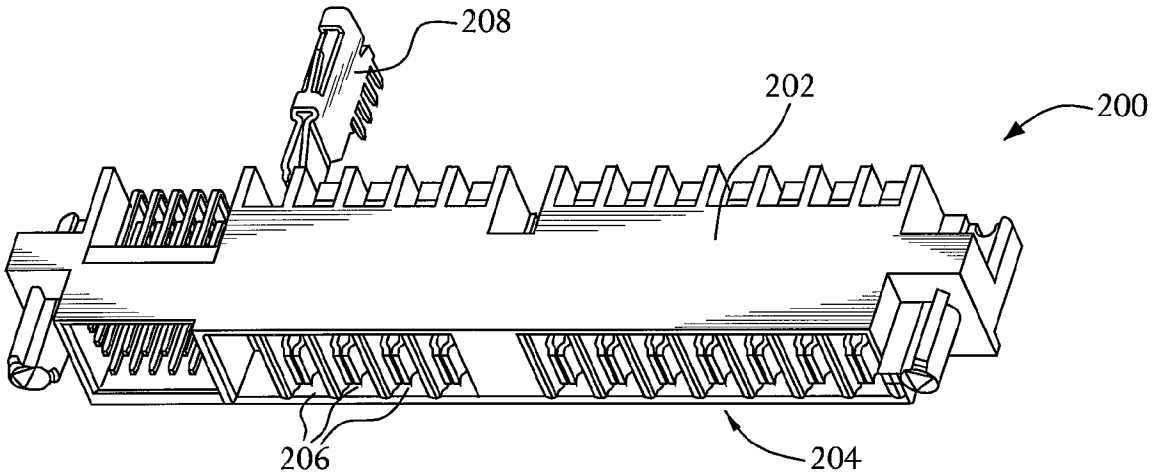
FIG. 15 is a front perspective view of a second embodiment of a plug connector.

FIG. 15 shows another plug connector 200 embodying the invention. In this embodiment, the housing 202, preferably formed of a molded polymeric material, has a front face 204 that forms the mating interface of the connector. The face 204 includes a plurality of openings, such as openings 206, formed in a linear array.

Figure 16:
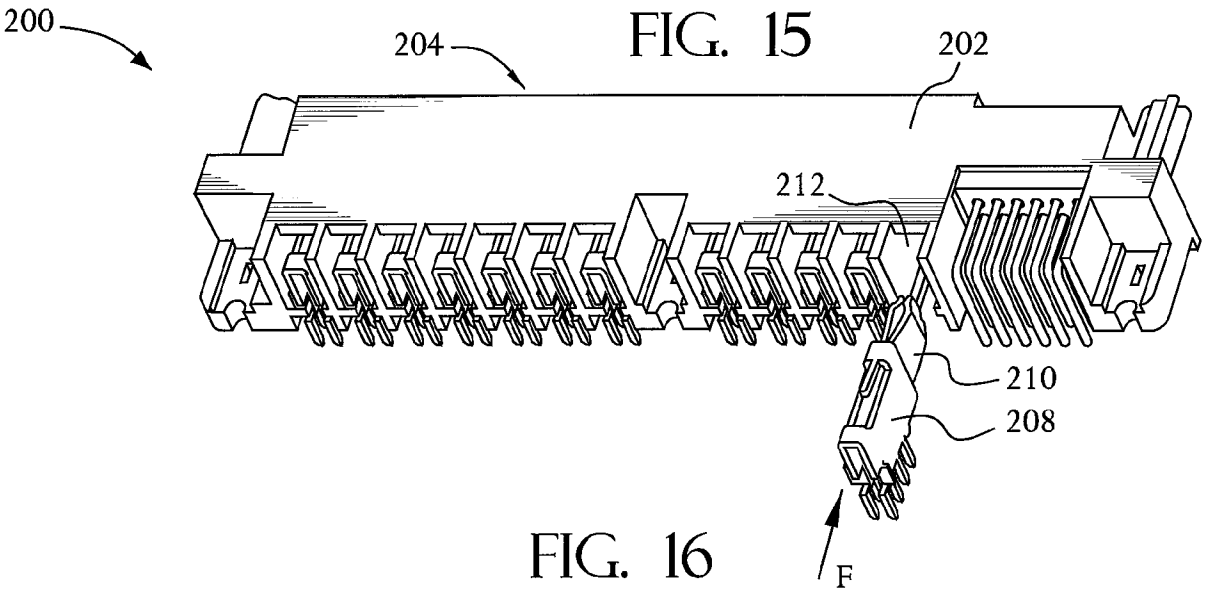
FIG. 16 is a rear perspective view of the plug connector of FIG. 15.

Referring to FIG. 16, the plug connector 200 includes a plurality of plug contacts 208. The contacts 208 are inserted from the rear of the housing into cavities 212 that extend from the rear of the housing toward the front of the housing. When the contacts 208 are fully inserted into the housing 202, the contact portions 210 with contacts 208 are disposed in the openings 206.

Figure 17:
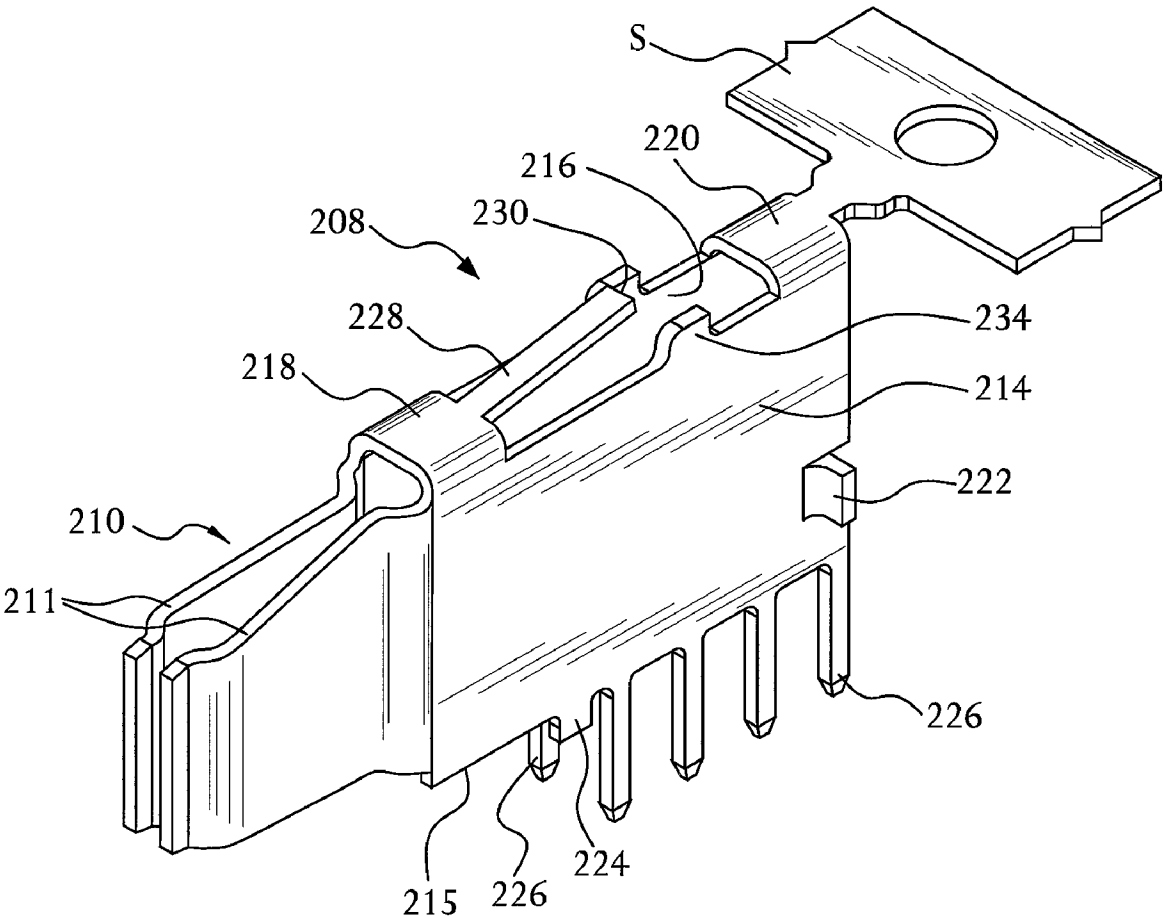
FIG. 17 is an isometric view of a plug contact used in the connector of FIG. 15, with the contact still attached to a portion of the strip material from which its formed.

Referring to FIG. 17, the plug contact 208 is similar in many respects to the plug contact shown in FIG. 1. It includes spaced panel-like walls 214, 216 that preferably are planar and substantially parallel. The walls 214, 216 are joined by a front bridging element 218 and a rear bridging element 220. In this embodiment, the contact section 210 is formed by two opposed cantilevered beams 211 that extend from front edges of the walls 214, 216. Preferably, each wall includes a fixing tang 224 formed along a bottom of the edge of the wall. The walls 214, 216 also include lateral positioning elements, such as bent tangs 222, for centering the contact within cavities 212 in housing 202. Each wall also includes a positioning feature, such as raised lug 234.

The front bridging element 218 includes a rearwardly extending retention arm 228 that is cantilevered at its proximal end from the bridging element. Arm 228 includes a locating surface 230 at its distal end.

Terminals, such as through-hole pins 226, extend from the bottom edge of each wall 214, 216. The terminals 226 can be solder-to-board pins (as shown) or can comprise press fit or other types of terminals.

As can be seen from FIG. 17, the contacts 208 can be formed from sheet stock by stamping and forming the part from a strip of metallic stock suitable for forming electrical contacts. The contacts 208 can be retained on a carrier strip S for gang insertion or separated from the strip prior to insertion into a housing.

Figure 18:
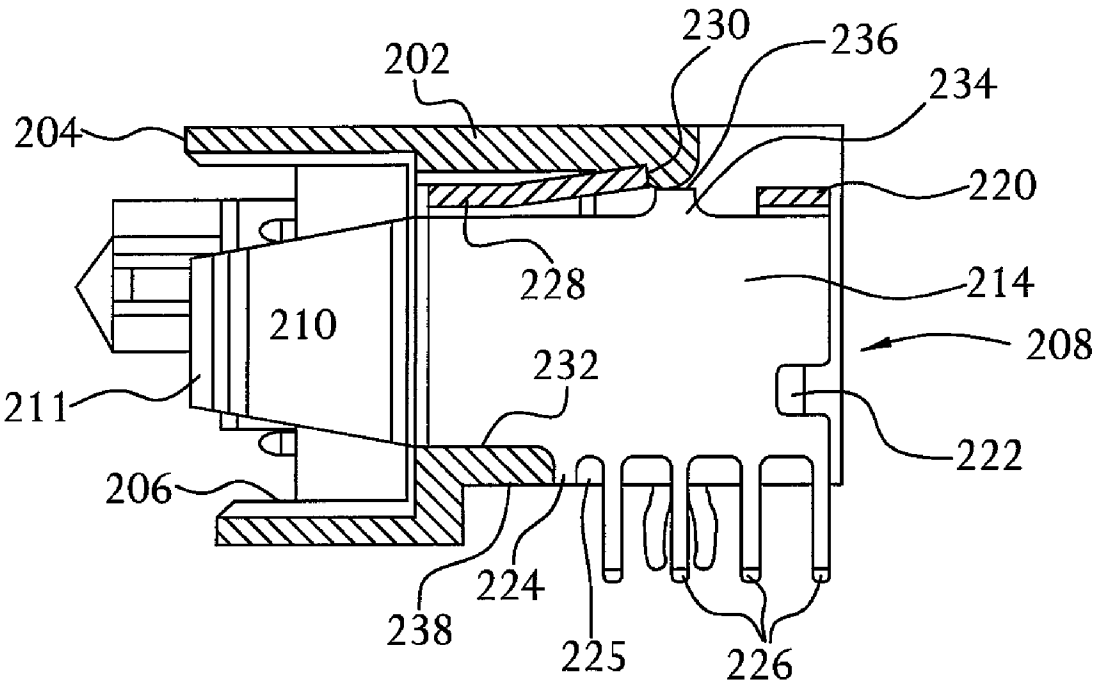
FIG. 18 is a side cross-sectional view of the plug connector of FIG. 15.

Referring to FIG. 18, the contact 208 is inserted into housing 202 from the rear into cavities 212 (FIG. 16). The contact 208 is located (in the vertical sense of FIG. 18) by engagement of the bottom edge 215 (FIG. 17) against surface 232 of the housing and by engagement of the top edges of the lugs 234 with the rib 236 in the upper part of the housing. The contact is maintained centered within the cavity 212 by the lateral tangs 222 that engage side walls of the cavity 212. The contact 208 is longitudinally locked in the housing (in the direction of contact mating) by means of the spring arm 228 that is deflected downwardly by the rib 236 of the housing during insertion and then resiles upwardly to position the stop surface 230 at its distal end against or near the forward surface of the rib 236.

The downwardly extending tang 24 is preferably received in a slot 225 in the housing, the width of the slot being substantially the same as the thickness of the tang 224. By capturing the tang 224 in the slot 225, deformation of the wall section, as might occur when the cantilever arms 211 of the contact section are urged toward each other, is limited to the portion of the walls 212, 216 disposed forwardly of the tangs 224. This enhances control of the contact normal forces generated by deflection of the cantilever arms 211.

As shown in FIG. 18, the terminals 226 extend below the bottom surface 238 of the housing 202, which bottom surface defines a mounting interface of the connector, along which it is mounted on a printed circuit board.

Figure 19:
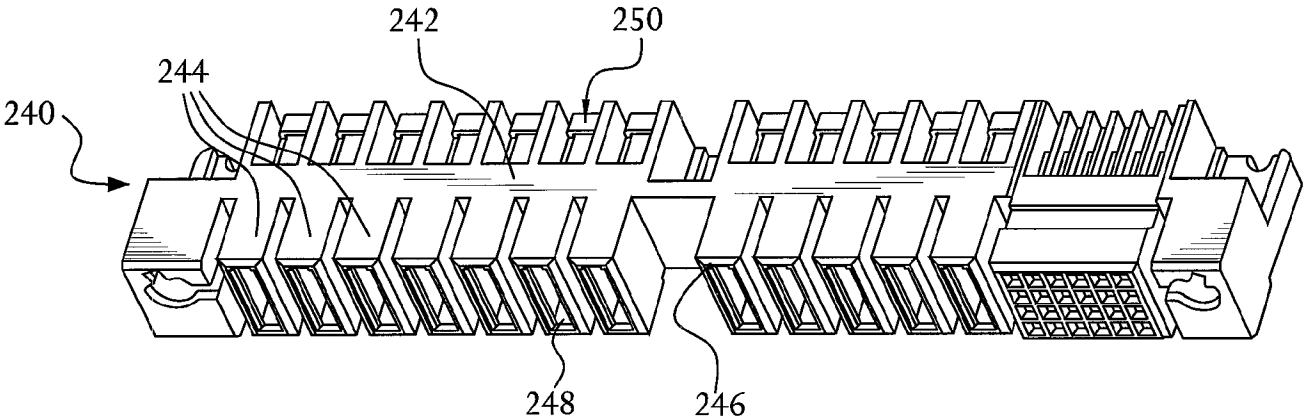
FIG. 19 is a front perspective view of a receptacle connector matable with the plug connector of FIG. 15.
Figure 20:
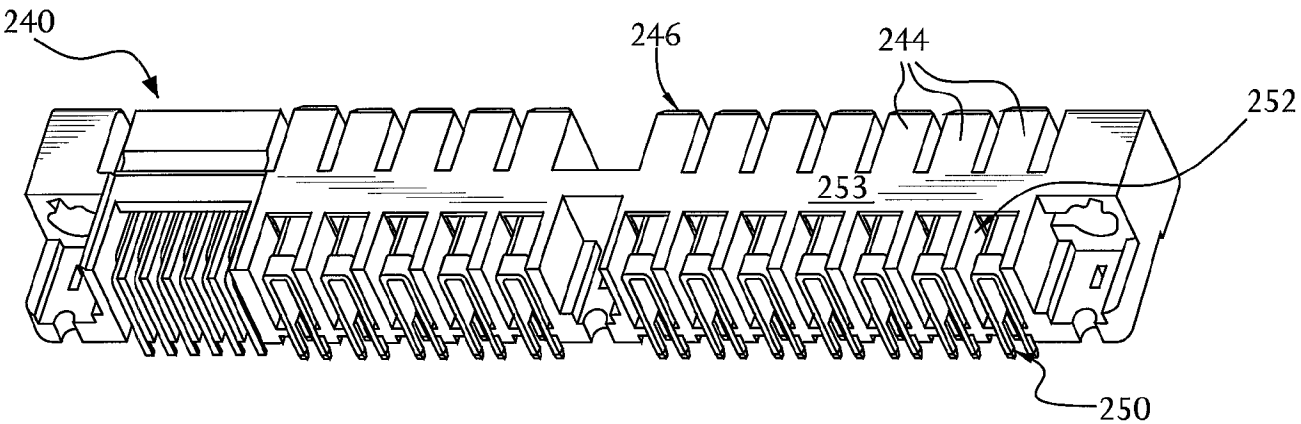
FIG. 20 is a rear perspective view of the receptacle connector shown in FIG. 19.

FIGS. 19 and 20 show a receptacle connector for mating with the plug connector illustrated in FIGS. 15-18. The receptacle connectors 240 include an insulative housing 242 that comprises an array of receptacle silos 244. The front surfaces 246 of the silos are substantially coplanar and form a mating interface of the connector. Each silo has an opening 248 for receiving the contact section 210 of the plug contacts 208 of the mating connector. The plurality of receptacle contacts 250 are mounted in the housing 242, preferably by insertion from the rear into cavities 252. As shown in FIG. 20, preferably the top wall 254 of the housing does not extend fully to the rear of the connector housing, thereby leaving substantial openings in the cavities 252.

Figure 21:
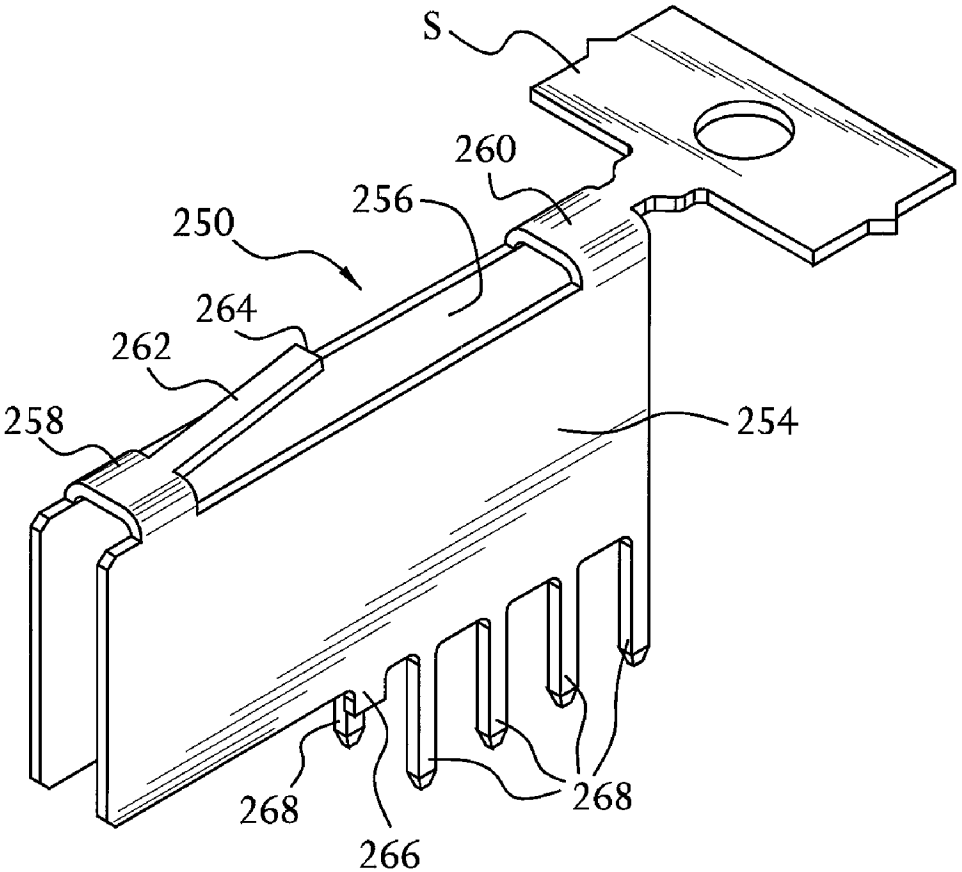
FIG. 21 is a isometric view of a receptacle contact used in the connector shown in FIG. 19, with the contact still attached to a portion of the metal strip from which it was formed.

The receptacle contact for receptacle connector 240 is illustrated in FIG. 21. The contact 250 is similar in basic form to the receptacle contact 48 illustrated in FIGS. 3 and 4. It includes two opposed walls 254, 256 that are preferably substantially planar and parallel, thereby forming between them a contact receiving and air flow space. The walls 254, 256 are joined by a front bridging element 258 and a rear bridging element 260. The front bridging element 258 includes a resilient latching arm that is cantilevered at its proximal end from bridging element 258 and carries at its distal end the latching or locking surface 264. As described previously, the receptacle contact 250 can be formed in a single, unitary piece, by stamping and forming the contact from a strip. As mentioned previously, the contacts can be inserted into the housing while attached to carrier strip S or after being separated therefrom.

Figure 22:
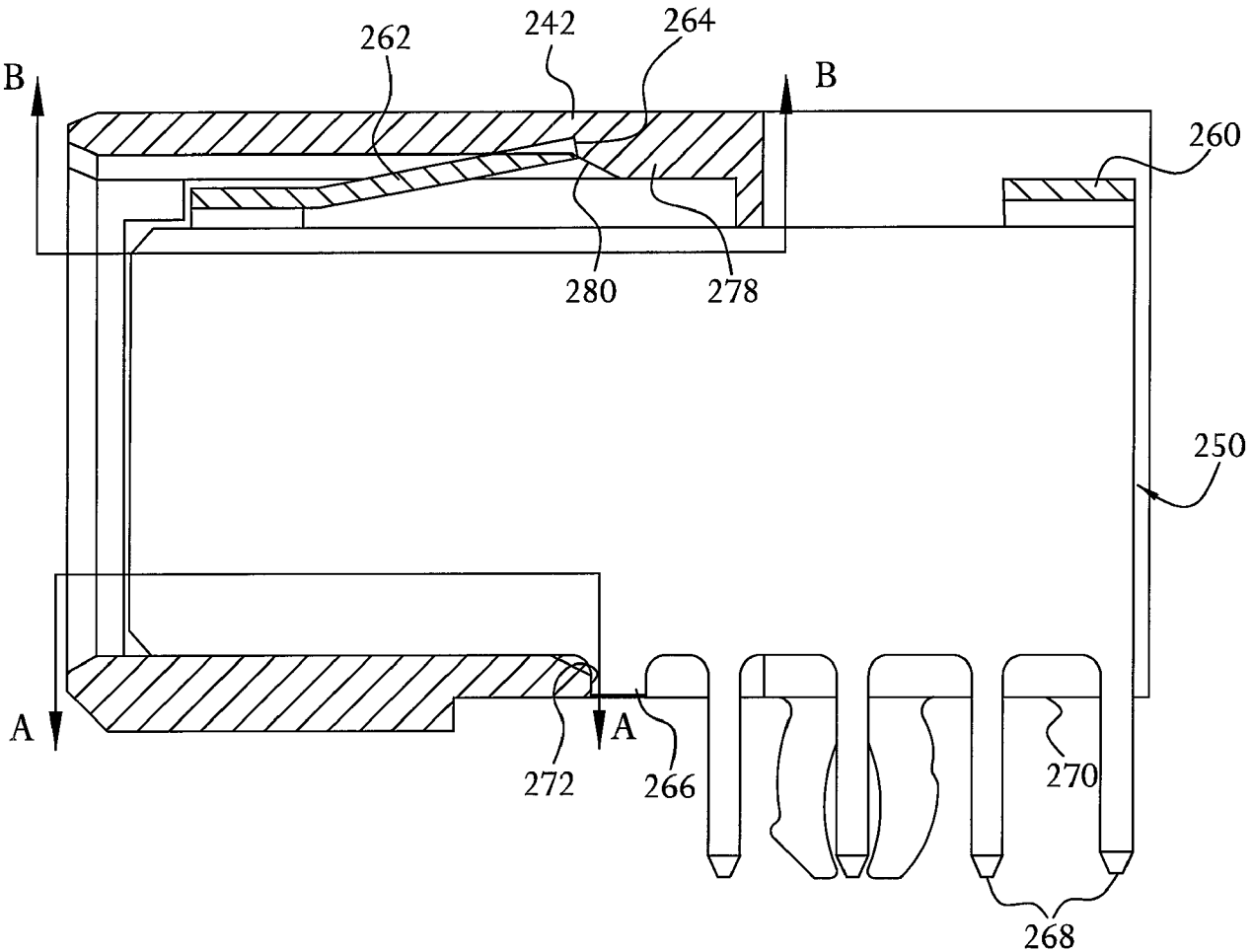
FIG. 22 is a side cross-sectional view of the receptacle connector shown in FIG. 19.

FIG. 22 is cross-sectional view showing a receptacle contact 250 inserted into housing 242. As shown, the locating tang 266 is positioned with its forward surface against the locating surface 272 in the bottom wall of the housing 242, thereby positioning the contact in its forward-most position. As the contact is inserted in the housing, the latching arm 262 is caused to resile downwardly when it engages the latching portion 278 of the housing. As the latching arm 262 resiles upwardly after it passes the latching section 278, the locking surface 264 engages a raised rib 280 (FIG. 22*b*) thereby locking the contact against rearward movement with respect to the housing. The terminals 268 extend beyond the surface 270 that forms the mounting interface of connector 240.

Figure 22A:
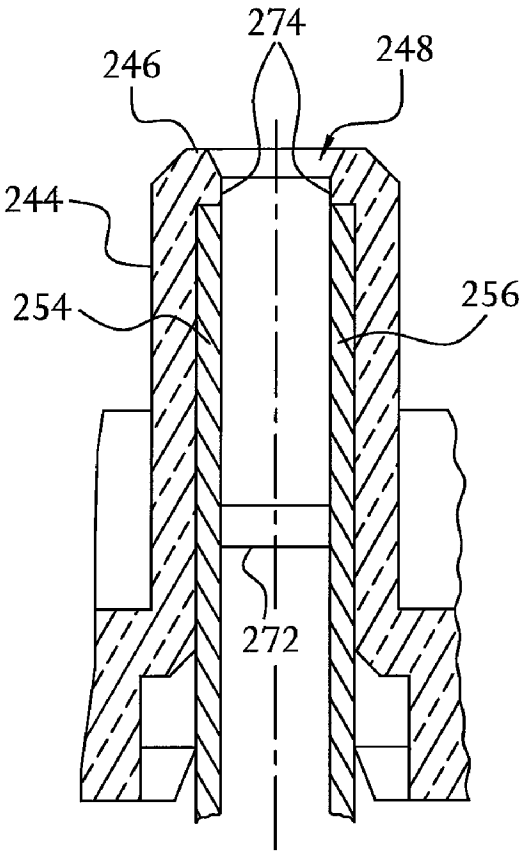
FIG. 22*a* is a partial cross-sectional view taken along line AA of FIG. 22.
Figure 22B:
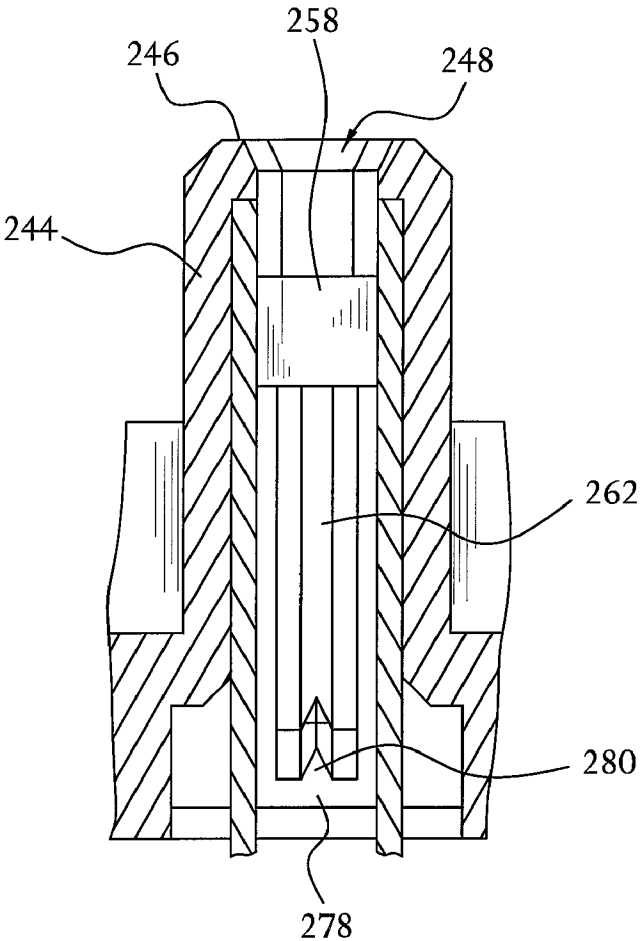
FIG. 22*b* is a partial cross-sectional view taken along line BB of FIG. 22.

As illustrated in FIGS. 22*a* and 22*b*, the forward portions of the walls 254, 256 are disposed along inside side walls of the silos 44. At the forward surface 246 of each silo, a plug contact receiving opening 248 is formed. The opening includes a pair of lips 274 that are coplanar with or extend just slightly beyond the inside surfaces of the walls 254, 256. This arrangement provides the benefit of lowered initial insertion forces when the connectors 200 and 240 are mated. As the silos 244 enter the openings 206 (FIG. 15), the contact sections 210 formed by the cantilevered arms 211 first engage the surfaces of lips 274. Because the coefficient of friction between the cantilevered arms 22 and the plastic lips 274 is relatively lower than the coefficient friction between the cantilevered arms and the metal walls 254, 256, initial insertion force is minimized.

Figure 23:
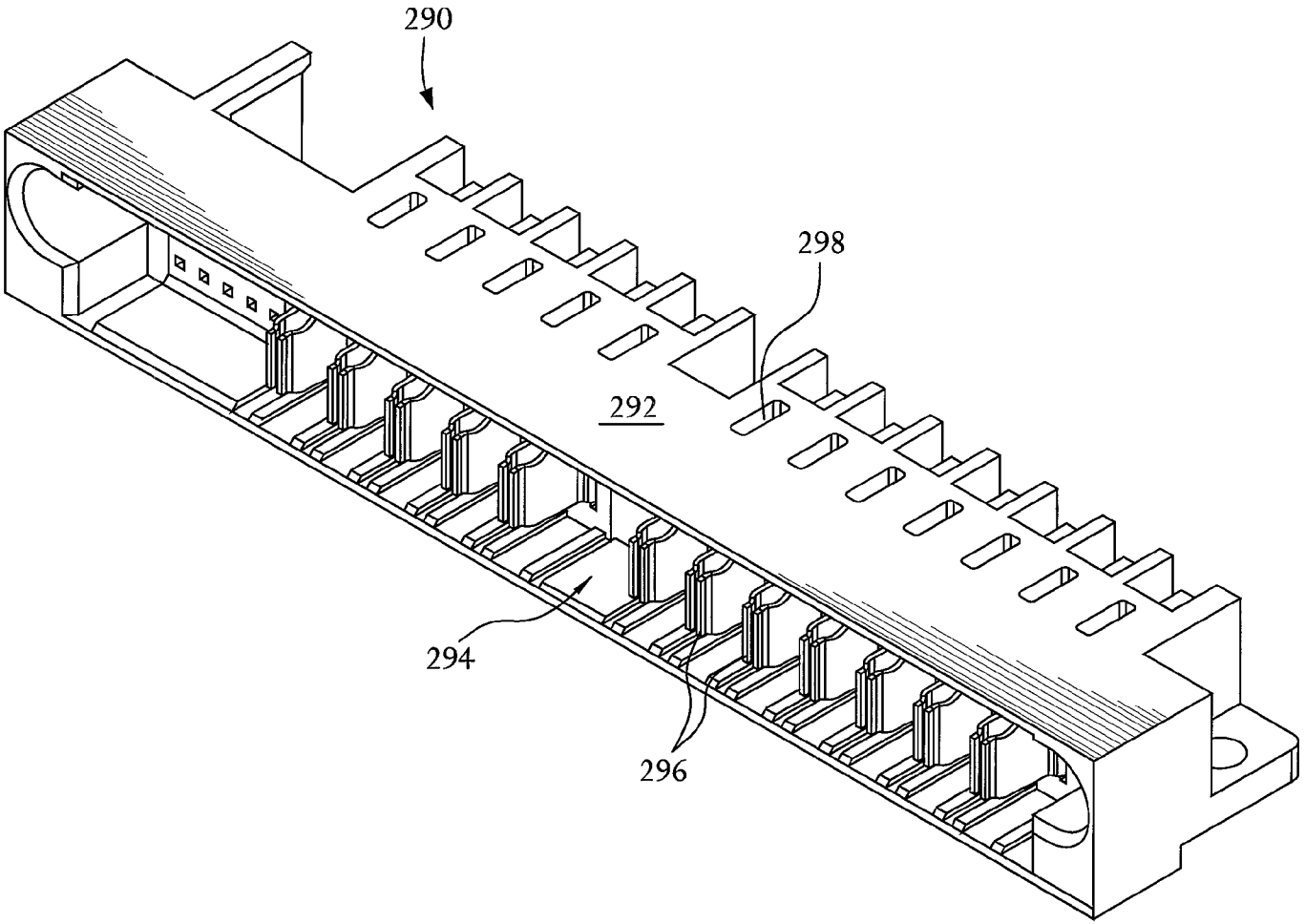
FIG. 23 is a front perspective view of a third embodiment of plug connector.
Figure 23A:
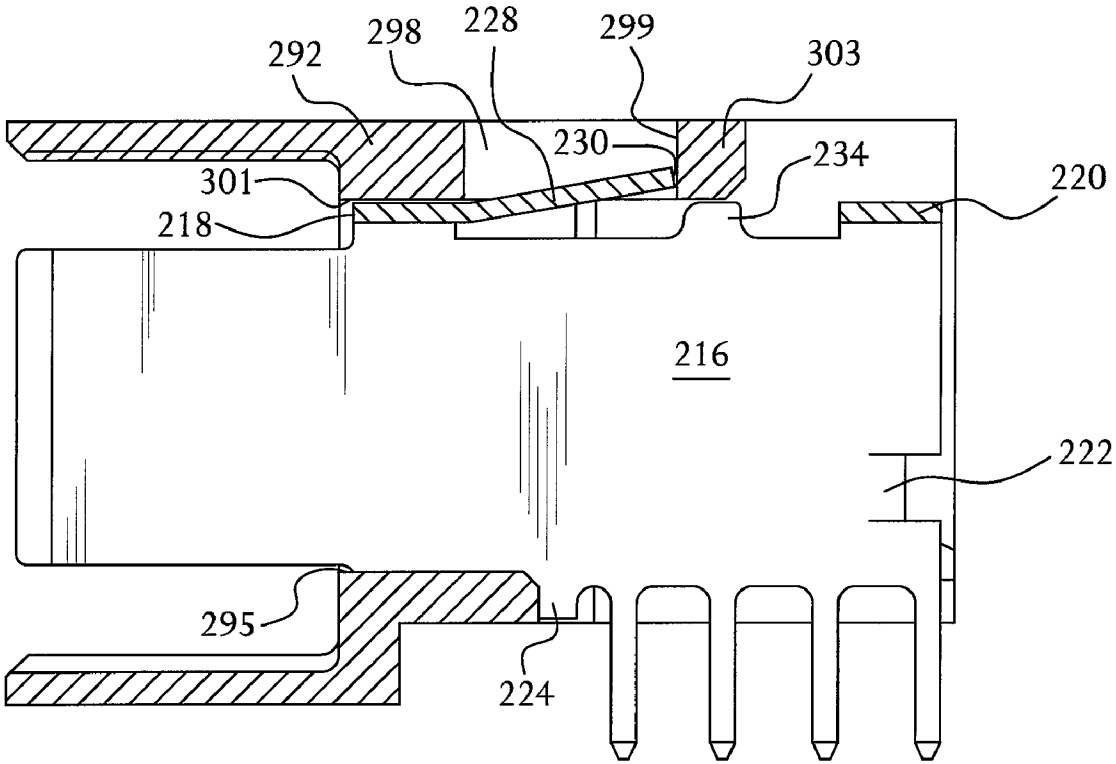
FIG. 23*a* is a cross-sectional view of an alternative arrangement for securing a contact in a housing.

FIG. 23 shows another embodiment of plug connector 290. In this embodiment, the housing 292 has a single front opening 294 in which the contact sections 296 of the plug contacts are disposed. The housing also includes a plurality of openings 298 in the top wall of the housing. As shown in FIG. 23*a*, the bridging element 218 and locating lug 234 engage the top surface 301 of the contact receiving cavity and the bottom surface 295 of the cavity in an interference fit. The arm 228 deflects downwardly as the contact is inserted into the housing and the arm engages portion 303. When the arm 228 clears portion 303, the arm resiles upwardly to locate stop surface 230 adjacent surface 299, thereby locking the contact against retraction. The openings 298 are positioned above the latching arms 228 (FIG. 18), to allow the arm 228 to be moved from a retention position and the contacts to be withdrawn from the housing. This can be accomplished by insertion of a suitable tool (not shown) through opening 298. Openings 298 can also provide air flow passages for enhancing heat dissipation.

Figure 24:
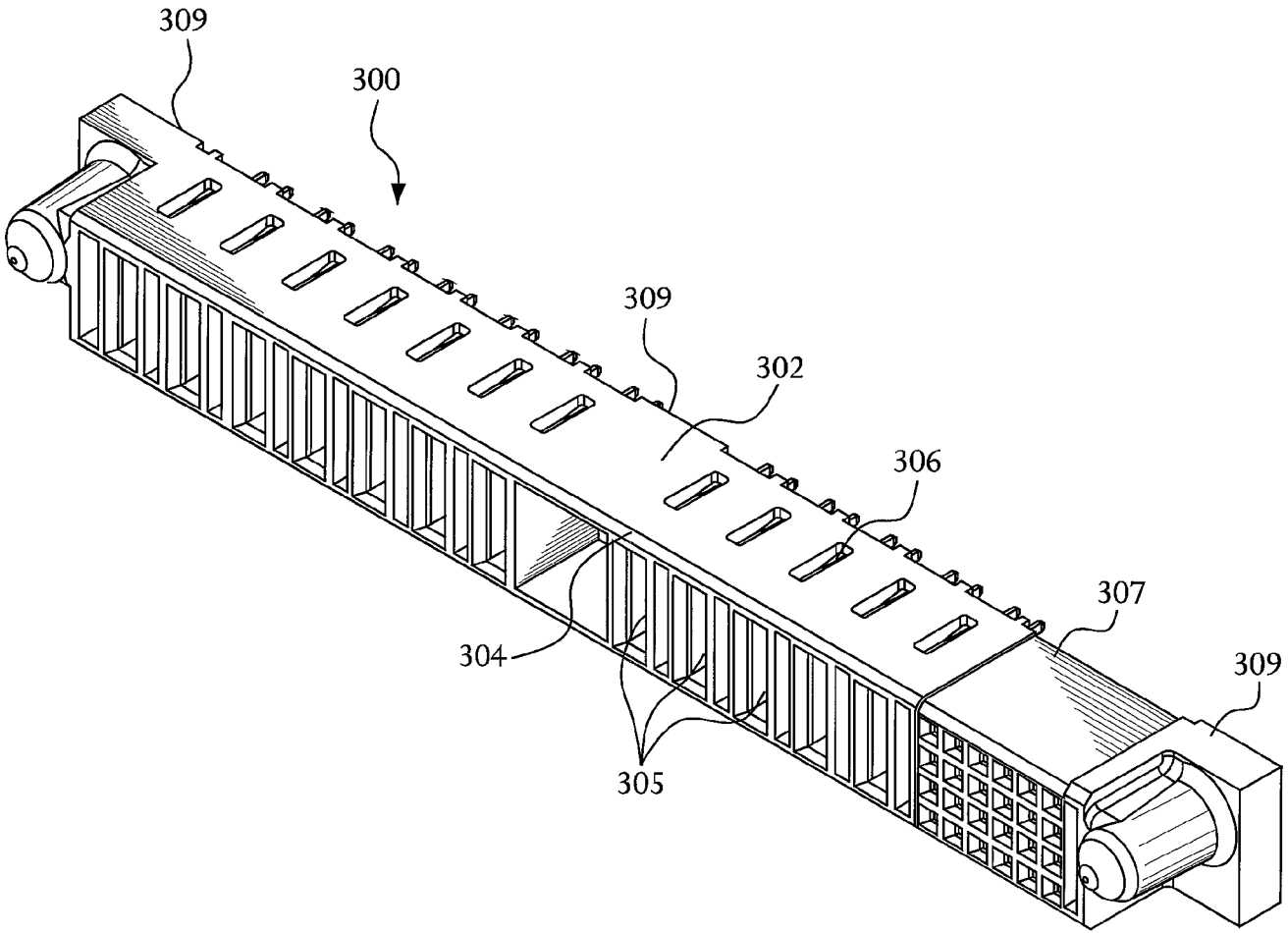
FIG. 24 is a front perspective view of a receptacle connector adapted to mate with the plug connector shown in FIG. 23.

FIG. 24 illustrates a receptacle connector 300 adapted to mate with plug connector 290. The receptacle connector 300 employs a housing 302 having a continuous front face 304, rather than a plurality of silos as in previous embodiments. The entire front face 304 of the connector 300 is received in opening 294, with the contact sections 296 inserted into openings 305 of face 304. Openings 306 in the top wall of the housing allow access to the latching arms of the receptacle contacts (not shown) as described in the previous embodiment.

Figure 25:
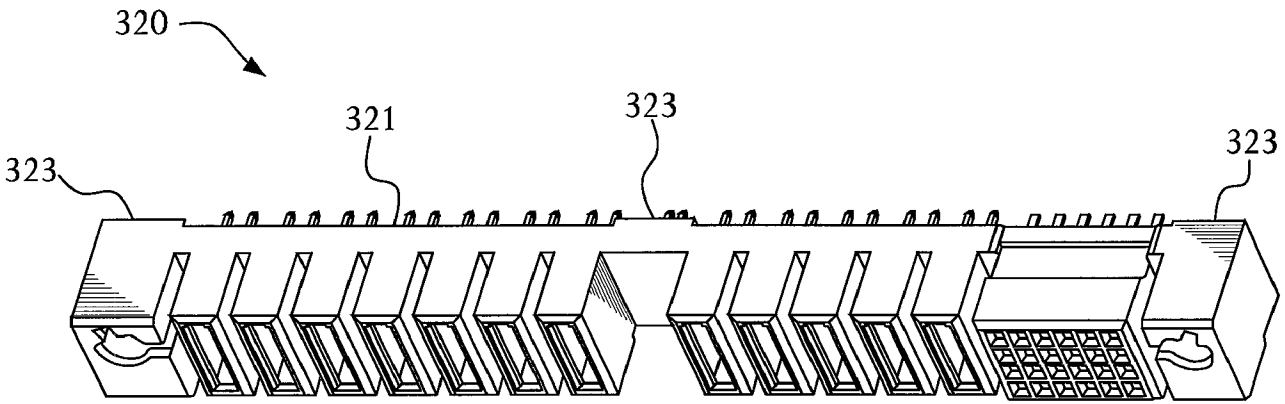
FIG. 25 is a front elevational view of another embodiment of a receptacle connector.
Figure 26:
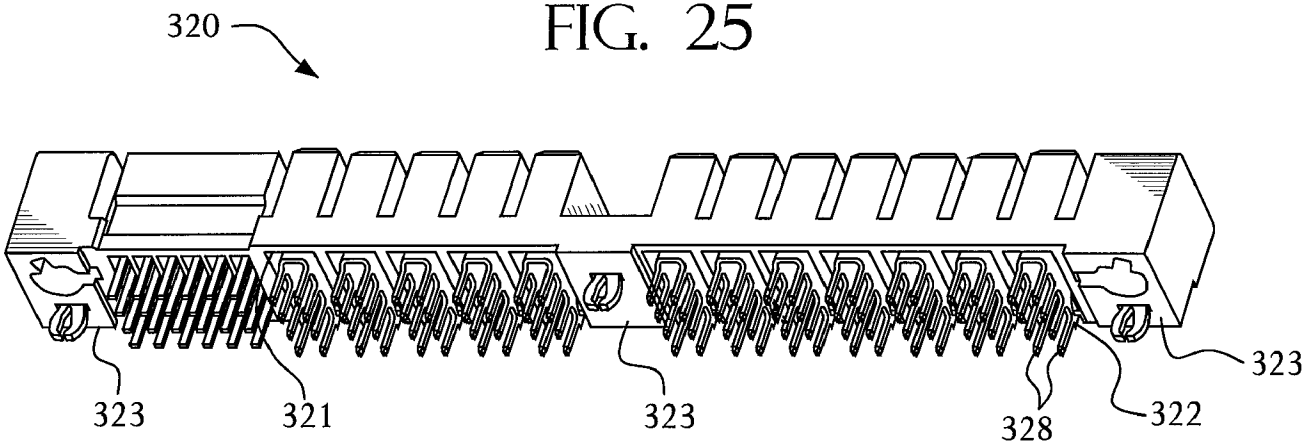
FIG. 26 is a bottom perspective view of the connector shown in FIG. 25.

The embodiment of FIG. 24 and also the embodiment of FIGS. 25 and 26 are meant for use in a vertical configuration, as opposed to a right angle configuration. The housing 302 of connector 300 (FIG. 24) has a bottom side 307. Preferably, a plurality of standoff surfaces 309 form a mounting interface, along which the housing is mounted on a substrate, such as a printed circuit board. Similarly, the housing of connector 320 has a bottom surface 321 with standoffs 323. Appropriate receptacle contacts 322 (FIG. 7) are inserted into the housings of connectors 300 and 320 from the bottom sides 307 and 321, respectively.

Figure 27:
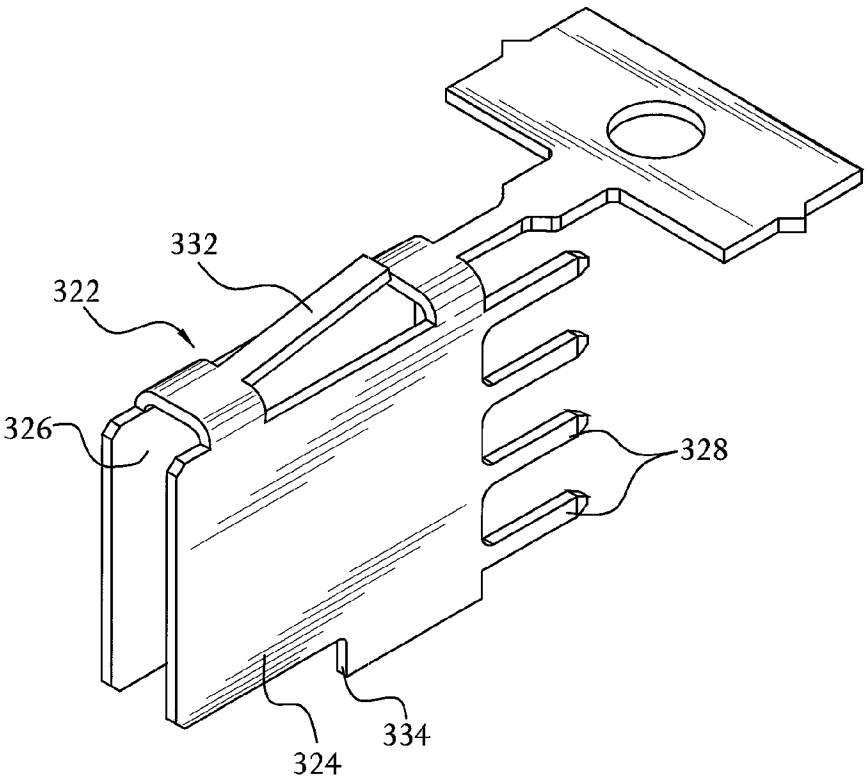
FIG. 27 is an isometric view of a receptacle contact used in the connectors illustrated in the FIGS. 25 and 26.
Figure 28:
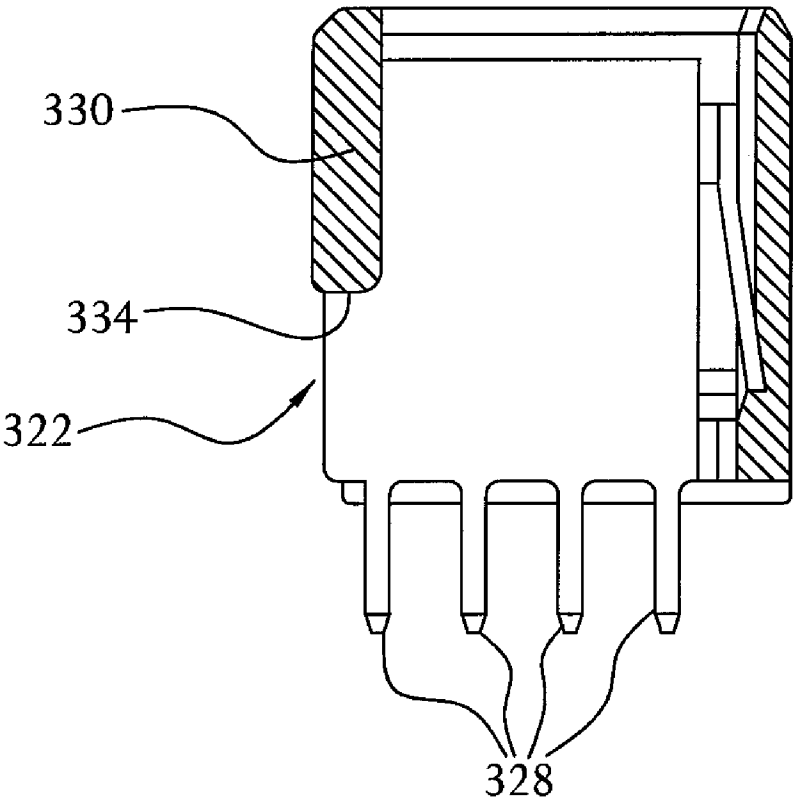
FIG. 28 is a cross-sectional view of a connector as shown in FIG. 25.

FIG. 27 shows a receptacle contact 322 comprising a pair of preferably planar parallel walls 324, 326 that form between them a contact receiving space for receiving plug contacts of the type previously described. This contact has terminals 328 extending from a rear edge of each of the walls. As shown in FIG. 28, the contact 322 is received in housing 330 in a manner similar to that previously described, wherein the resilient latching arm locks the contact against downward (in the sense of FIG. 28) movement, while a locating surface 334 locates the contact in the opposite direction with respect to the housing. The terminals 328 extend beyond the plane of the mounting interface of the connector housing for insertion into through holes in the printed circuit board.

Figure 29:
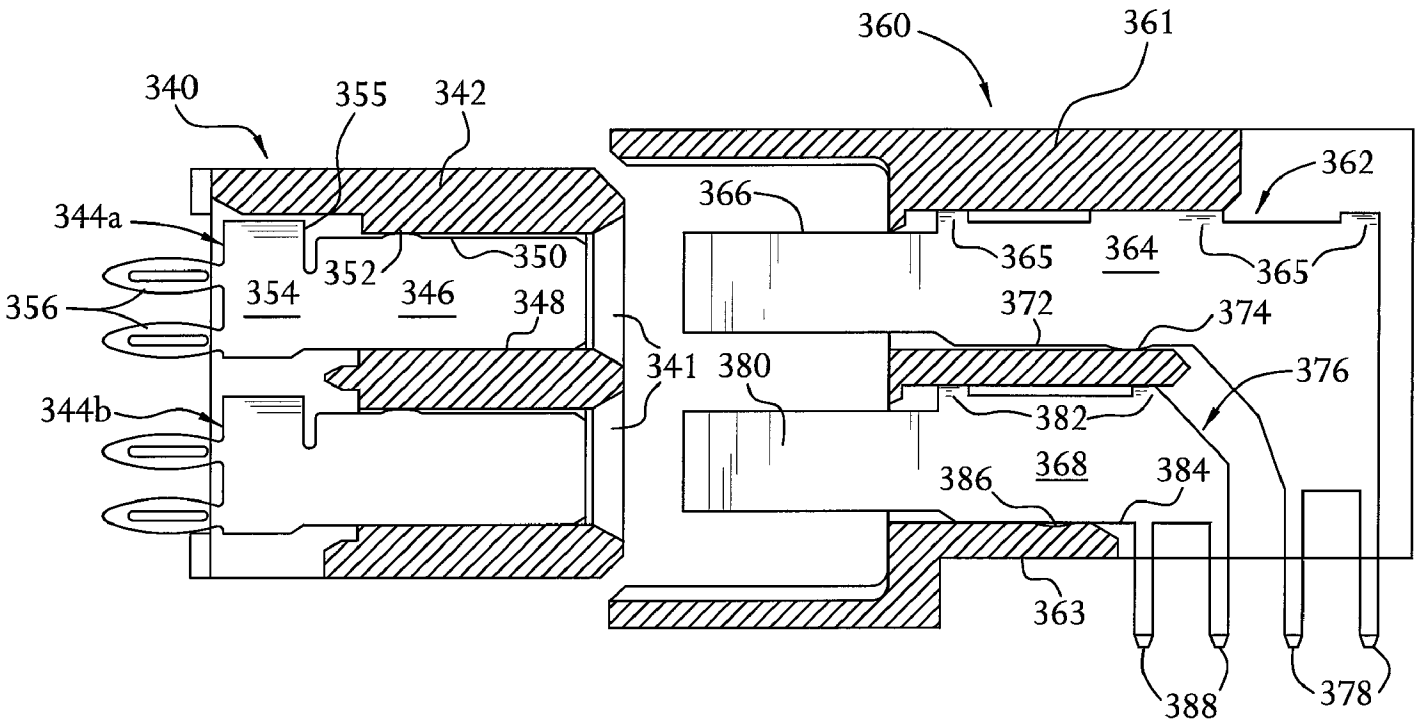
FIG. 29 is a cross-sectional view of an embodiment employing stacked contacts in the plug and receptacle connectors.

FIG. 29 shows an embodiment employing two sets of contacts at each location, in a stacked configuration. The receptacle connector 340 has a housing formed of insulative material. The housing 342 includes a mating interface having a plurality of openings 341. Each of the openings 341 open into cavities in housing, which cavities receive substantially identical receptacle contacts 344*a* and 344*b*. Each of the contacts 344*a* and 344*b* is similar in general construction to the receptacle contacts previously described, there being a pair of such contacts in each cavity, generally aligned along the side walls thereof, to form a gap between generally parallel plate sections 346. The plate sections 346 have two opposed edges 348 and 350, one of which carries a retention feature, such as interference bump 352. The receptacle contact sections 346 are retained in the housing by suitable means, such as an interference fit created by the bump 352. Each contact section 356 includes a generally coplanar wall section 354. The wall sections 354 are joined by a bridge section 355. Suitable terminals, such as press fit terminals 356 extend from an edge of the wall section 354, in the case where the connector 340 is to be used in a vertical configuration.

The mating plug connector 360 includes a molded polymeric body 361 that receives a pair of plug contacts, such as upper plug contact 362 and the lower plug contact 376. These plug contacts are configured generally in the manner previously described, namely, being formed of a pair of spaced wall sections 364 and 368 respectively joined by bridging elements and carrying opposed contact beams 366 and 380 to engage the spaced receptacle plates 346. The plug contact 362 includes a single, relatively long, or several, relatively short, bridging elements 365 that join two opposed plates 364. The bottom edge 372 of each of the plates 364 includes retention structure, such as an interference bump 374. The plug contact 362 is retained in its cavity within housing 361 by an interference fit between the bridging elements 365 and the interference bump 374, although it is contemplated that other retention mechanisms could be utilized. Similarly, lower plug contacts 376 comprise a pair of coplanar wall or panel members 378 joined by one or more bridging elements 382. The lower edge 384 of each wall 378 includes an interference bump 386, that functions to create an interference fit, as previously described. Suitable terminals 368 and 380 extend from each of the panels 364 and 368, beyond the mounting interface 363 of the housing 361, for associating each of the contacts 362 and 376 with electrical tracks on the printed circuit board on which the plug 360 is to be mounted.

The previously described receptacle and plug contacts may be plated or otherwise coated with corrosion resistant materials. Also, the plug contact beams may be bowed slightly in the transverse direction to enhance engagement with the contact receiving surfaces of the receptacle contacts.

The "dual-mass" construction of both receptacle and blade contacts, employing opposing, relatively thin walls, allows for greater heat dissipation as compared with prior "singular-mass" designs. The enhanced heat dissipation properties result from the contacts having greater surface area available for convection heat flow, especially through the center of the mated contacts. Because the plug contacts have an open configuration, heat loss by convection can occur from interior surfaces by passage of air in the gap between these surfaces.

The contacts also contain outwardly directed, mutually opposing receptacle beams and dual, peripherally located, mating blades, in a configuration which can allow for flexibility in modifying contact normal forces by adjustment the contact connector geometry. This can be accomplished by modifying the bridging elements to change bend radius, angle, or separation of the walls of the contacts. Such modifications cannot be accomplished with conventional singular-mass beam/blade configurations wherein the opposing receptacle contacts are inwardly directed, and the mating blade is located in the center of said beams.

Such dual, opposing, planar contact construction also allows for easier inclusion of additional printed circuit board attachment terminals with more separation between terminals, compared to an equivalent "singular-mass" bulk designs. The use of relatively larger plates in the plug and receptacle contacts gives this opportunity for providing a plurality of circuit board terminals on each contact part. These lessens constriction of current flow to the printed circuit board, thereby lowering resistance and lessening heat generation.

The use of a compliant plug mating section allows the receptacle contacts to be placed in a protected position within the molded polymeric housing for safety purposes. This feature is of further benefit because it allows minimization of amount of polymeric material used in making the housing. This lowers material costs and enhances heat dissipation. Also, by retaining the contacts in the housing in the manner suggested, thick wall structures can be avoided and thin, fin like structures can be utilized, all of which enhances heat dissipation from the connectors. Additionally, first-make, last break functionality can be incorporated easily into disclosed connector system by modifying the length of the mating portion of the plug contacts or by changing the length of the plug-receiving portion of the receptacle contacts.

The arch connection structure between opposing rectangular contact sections also allows for attachment of retention means, such as a resilient arm structure as shown in one of the current embodiments, in a manner that does not limit current flow or hinder contact heat dissipation capability.

It will also be appreciated that the plug and receptacle contacts may be manufactured from closely similar or identical blanks thereby minimizing tooling requirements. Further, the plug or receptacle connectors can easily be associated with cables, by means of paddle boards.

Figure 30:
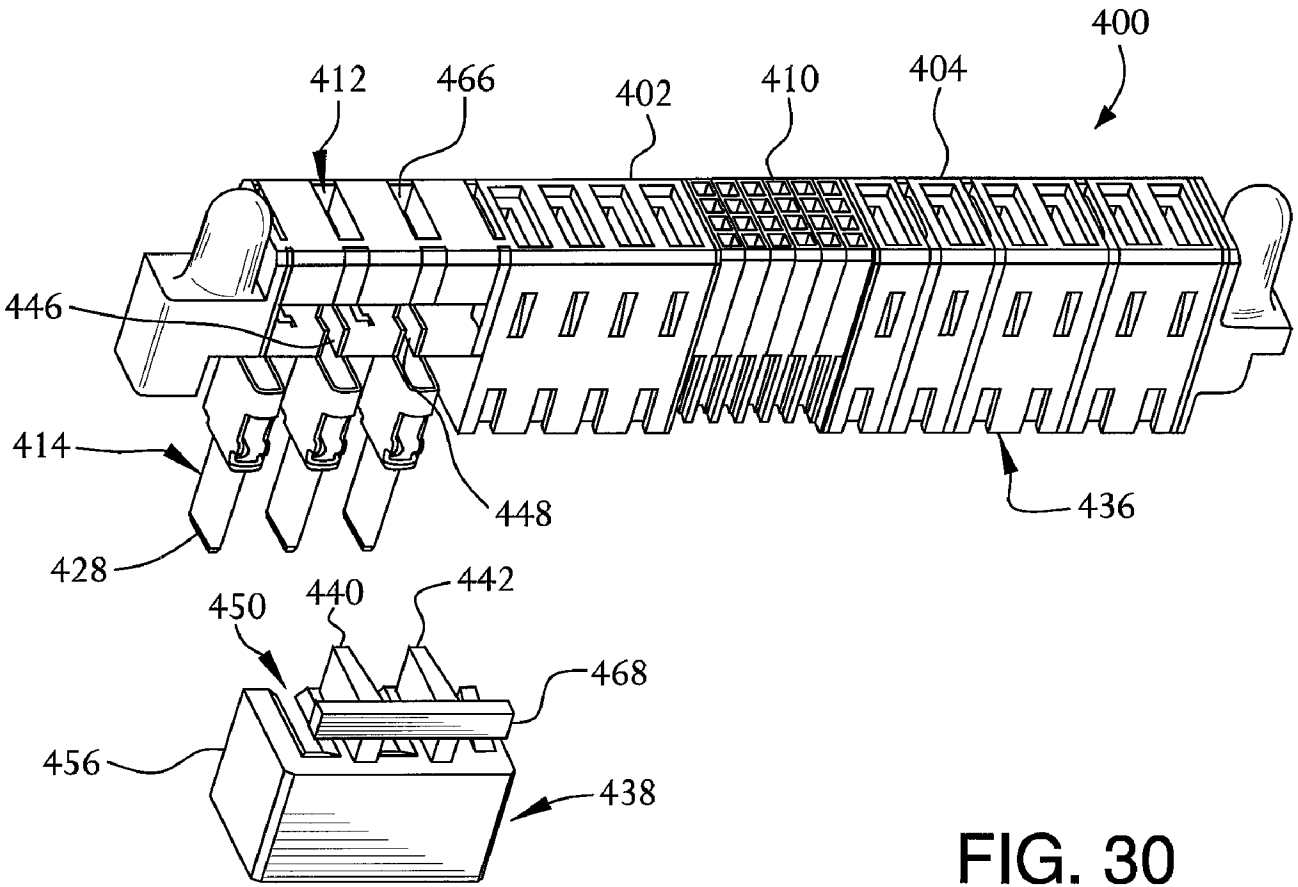
FIG. 30 is a top front perspective view of a receptacle connector incorporating AC power cable connections, including a spade terminal shroud.
Figure 31:
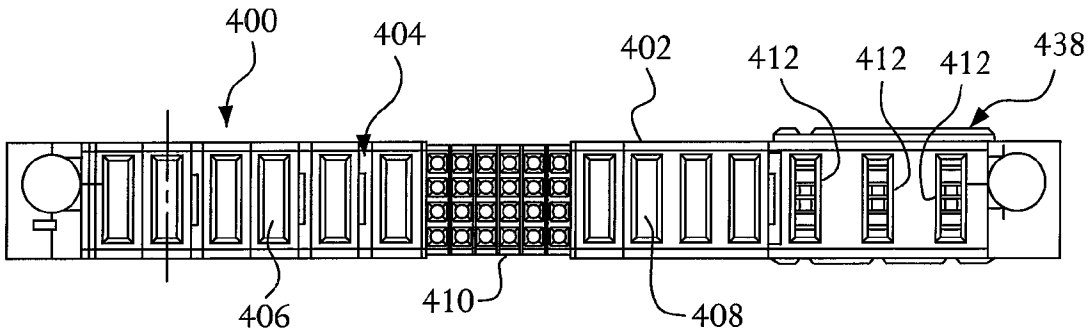
FIG. 31 is a top plan view of the receptacle connector shown in FIG. 30.
Figure 32:
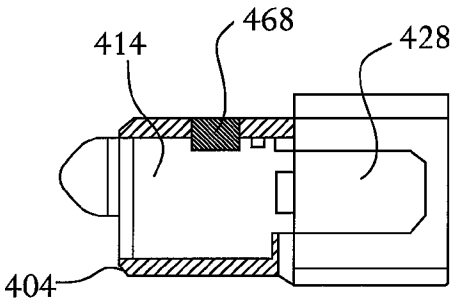
FIG. 32 is a side cross-sectional view taken along line AA of FIG. 31.

Any of the power connectors previously described herein can be modified to accommodate connections for an external AC power supply. For example, the insulative housing of the receptacle connector shown in FIG. 10, which has been previously described as providing for the ability to provide for signal and power connections, can be extended to accommodate additional openings for incorporation of contact terminals therein, which terminals provide connection to the external AC power input terminals. An illustrative embodiment is shown in FIGS. 30-32, which shows a signal and power receptacle connector 400 of the type described in the parent application, U.S. patent application Ser. No. 09/160,900, incorporating AC power cable connections.

The receptacle connector 400 includes an insulative housing 402 with a front side 404 including an array of contact openings, such as openings 406 and 408. Front side 404 also includes a signal receptacle in the form of signal pin receiving area 410 with signal pin receiving apertures. One of ordinary skill in the art will understand that the portion of the receptacle connector 400 that includes the contact openings 406 and 408 and the signal pin receiving area 410 is similar in many respects to the connectors described previously. A receptacle contact, such as any one of those described previously, is disposed and retained within a corresponding opening of the receptacle housing. The connector is shown in FIG. 30 with those contacts (and signal pins) other than the AC power supply contacts removed for clarity. In this regard, a connector including AC cable connections is not intended to be limited to any particular arrangement of the contacts and contact openings, as well as the configuration thereof, that have been described previously.

Included in the front side 404 of the housing 402 are three exemplary AC power contact openings 412. Disposed and retained within each of the AC power contact openings 412 is a corresponding AC power spade terminal 414. The AC power contact openings are sized and configured to receive the AC spade terminals 414 with an interference fit and in a preferred embodiment the terminals are retained in the housing in a manner described below.

Figure 33:
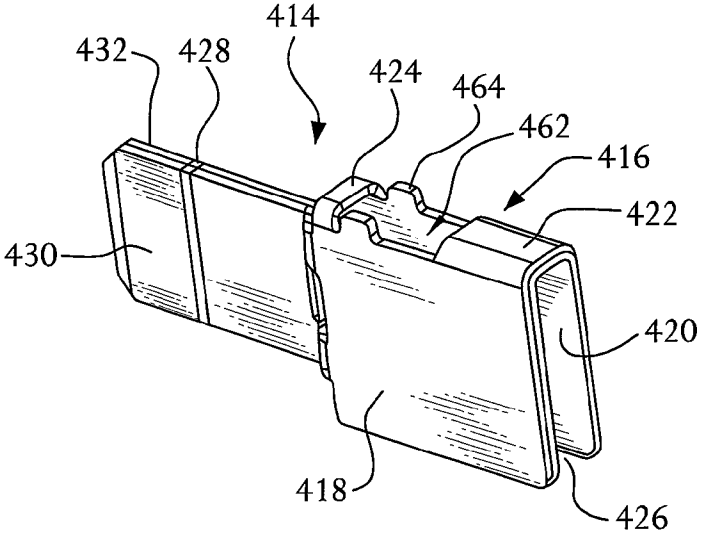
FIG. 33 is a perspective view of a spade terminal.
Figure 34:
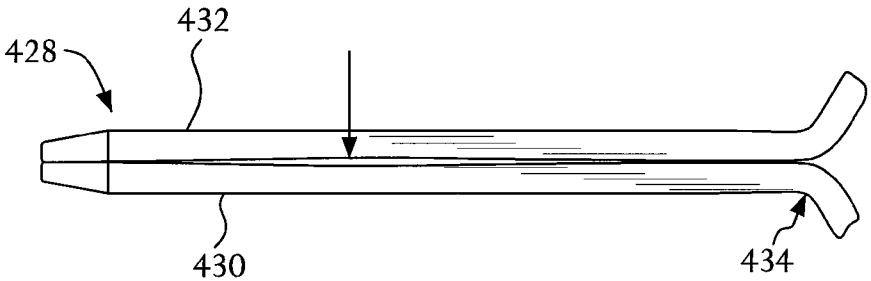
FIG. 34 is an enlarged view of the cable plug-up portion of the spade terminal shown in FIG. 33.

FIGS. 33 and 34 show the AC power spade terminal 414. The rear portion 416 of the terminal comprises two opposing major side walls 418 and 420, which are preferably planar and parallel in a manner similar to the side wall portion of the contacts described in FIGS. 1-4. In a manner similar in many respects to the contacts described previously, the side walls 418 and 420 of spade terminal 414 are connected by arcuate bridging elements 422 and 424. Again, similar to the previously described contacts, a medial space 426, adapted for air flow, is defined between side walls 418 and 420. Thus, one of ordinary skill in the art will recognize that the benefits of heat dissipation provided by the previously-described contacts having opposing side walls are also provided by AC power spade terminal 414. The AC power spade terminal 414 further includes cable plug projection 428. Cable plug projection 428 comprises a pair of opposed cantilever beams 430, 432 with each such beam being integrally joined to proximal portion 434, which integrally joins a respective beam to a respective side wall. The AC power spade terminal is stamped or otherwise formed as a single unitary piece from a strip of suitable contact materials such as phosphor bronze alloys or beryllium copper alloys. The spade terminal, or portions thereof, may be plated or otherwise coated with corrosion resistant materials The cable plug projection 428 of each AC power spade terminal according to the invention provides for engagement with a corresponding quick connect socket on the end of a corresponding AC power cable wire lead. These quick connect sockets are known in the art. The cantilevered beams 430 and 432 are closely spaced together, particularly at their respective proximal and distal ends, in a state prior to engagement with the quick connect socket and each of the cantilevered beams has a slight arc near the mid-point of the beam, as shown in FIG. 34. The configuration of the beams 430 and 432 in this manner creates a spring-like effect upon engagement of the cable plug projection 428 into the quick connect socket of the cable wires. The spring design feature of this spade terminal provides for a secure and positive locking engagement of the quick connect socket onto the AC power spade terminal and also provides more forgiveness in the mating between the plug projection and the quick connect socket in those circumstances where the quick connect socket is not flexible, such as where the quick connect sockets of the AC cable wires are molded inside a plastic connector housing.

Figure 36:
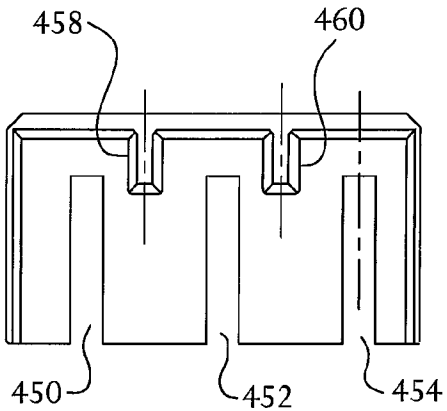
FIG. 36 is a bottom plan view of the shroud shown in FIG. 35.
Figure 35:
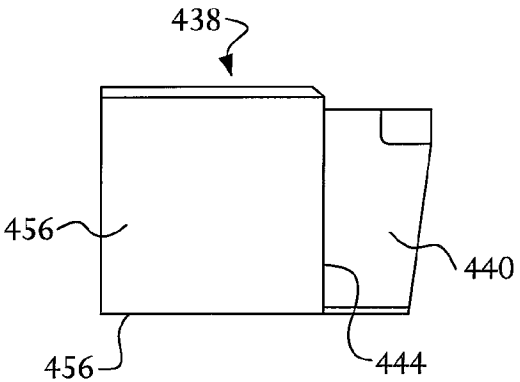
FIG. 35 is a side view of a shroud for the AC power supply spade terminals.
Figure 37:
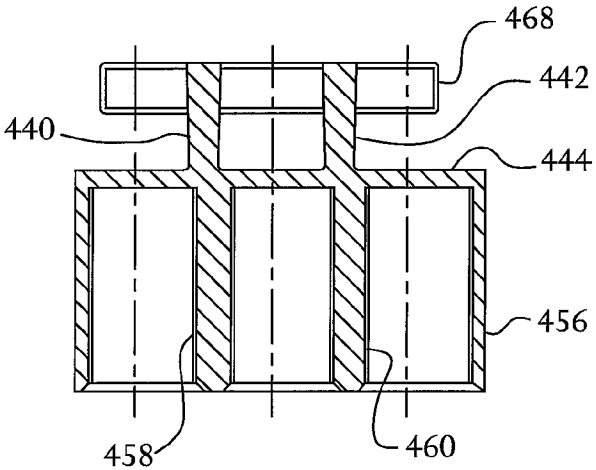
FIG. 37 is a bottom cross-sectional view taken along line AA of FIG. 35.
Figure 38:
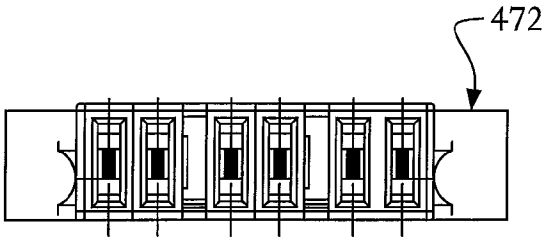
FIG. 38 is a top plan view of another receptacle connector incorporating AC power cable connections.
Figure 39:
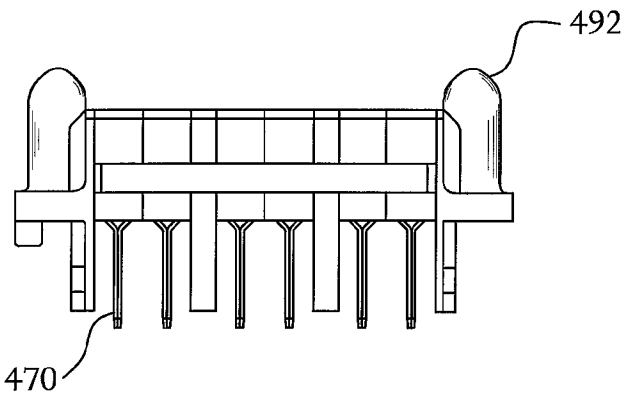
FIG. 39 is a side view of the connector shown in FIG. 38.
Figure 40:
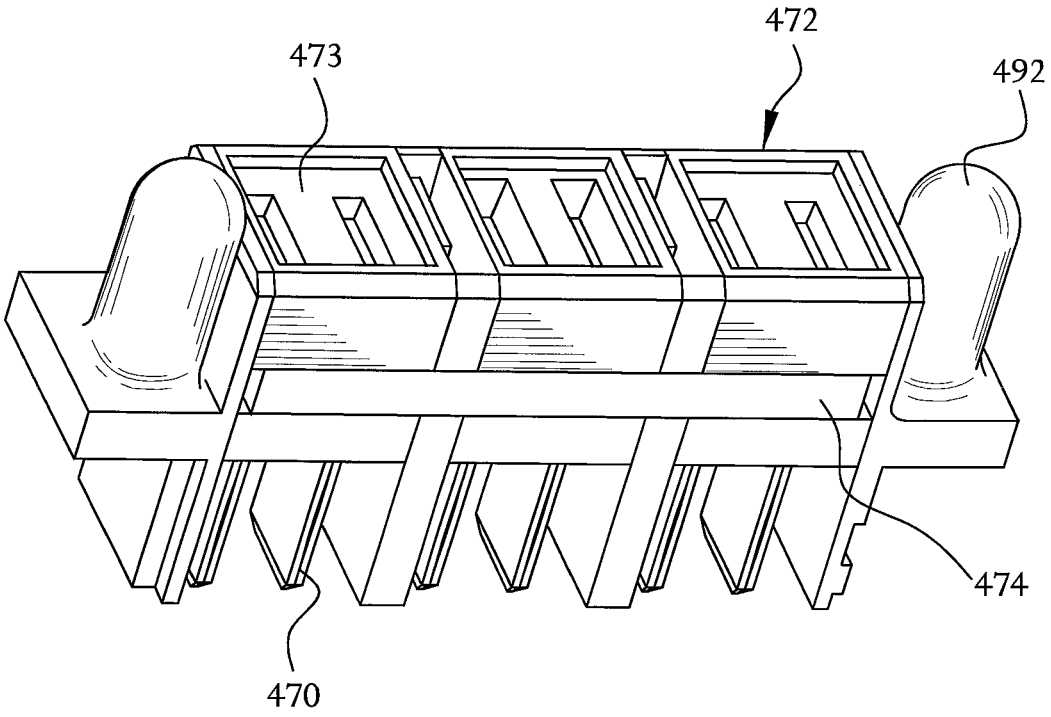
FIG. 40 is a top front perspective view of the connector shown in FIG. 38.
Figure 41:
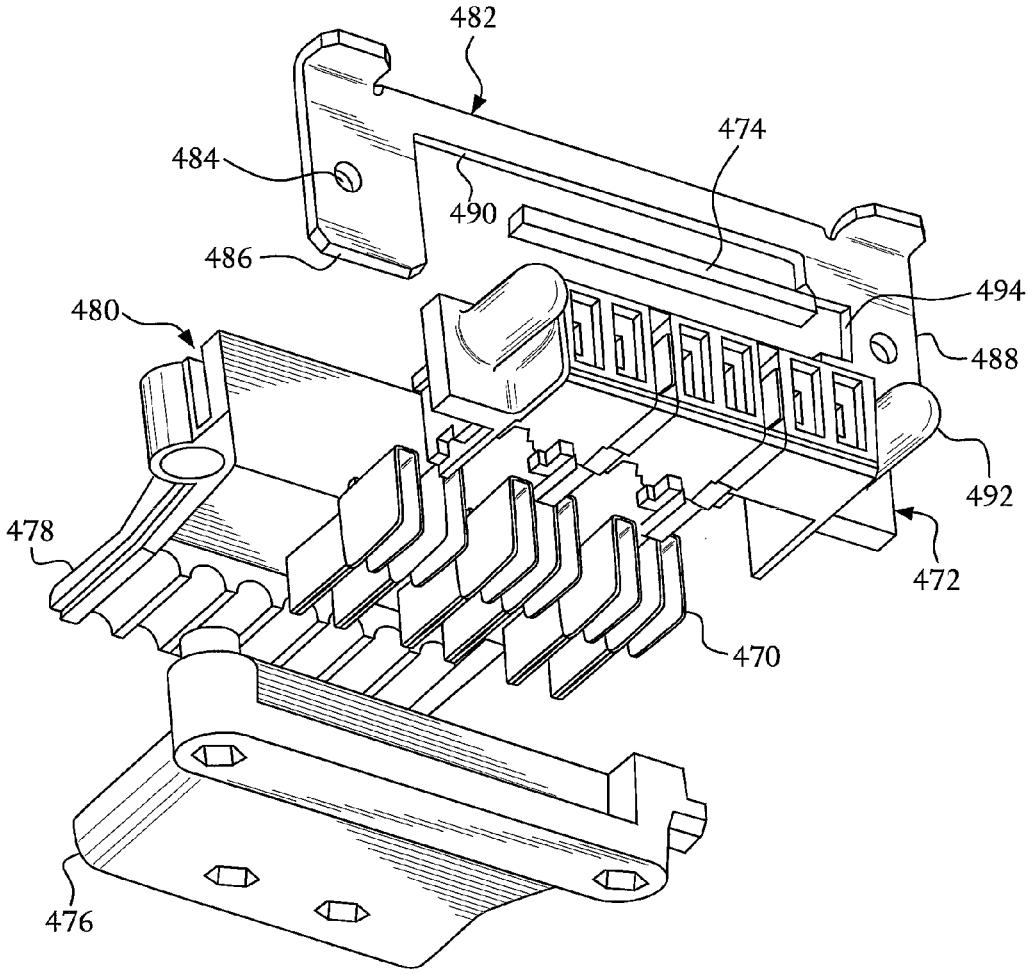
FIG. 41 is an exploded perspective view of the connector shown in FIG. 38, including a mounting bracket.

The cable plug projection 428 of each of the AC power spade terminals 414 extends a significant distance beyond the rear face 436 of the connector housing 402 so that the cable plug projection of each spade terminal can be mated with a corresponding quick connect socket of an AC power cable wire. One of ordinary skill in the art will recognize that significant current levels will be maintained through the AC power spade terminals. In order to protect the spade terminal and quick connect socket connection from coming into inadvertent contact with a user that may be installing other components into the system, a protective shroud 438 may be joined to the connector housing to cover the spade terminals connections, as shown in FIG. 30. Referring also to FIGS. 35-37, the shroud has two rear projections 440 and 442 that protrude from the rear face 444 of the shroud 438. To seat the shroud in place over the spade terminal contacts, the two rear projections 440 and 442 of the shroud are inserted into corresponding slots 446 and 448 in the connector housing 402. The shroud also has three slotted openings 450, 452, and 454 that are formed in the rear face 444 and the bottom face 456 of the shroud. When the rear projections 440 and 442 are seated into the slots 446 and 448 of the housing, the slotted openings 450, 452, and 454 receive a corresponding AC power spade terminal 414 such that the spade terminal becomes enshrouded by the shroud casing 456 when the shroud is seated into position onto the connector housing 402. The shroud also incorporates polarization hubs 458 and 460 to ensure a proper orientation of the shroud onto the connector housing. The shroud may be made of any suitable molded plastic material.

The connectors described thus far have been illustrated with three AC power spade terminals incorporated into the connector housing for receiving an external AC power supply connection. The present invention is not intended to be limited in this manner and the connector could be designed to accommodate six of more spade terminals for receiving any corresponding number of AC power supply connections. Also, the present invention is not intended to be limited to the particular design of the AC power spade terminals described herein, nor the configuration of the spade terminals inside the connector housing. Furthermore, direct incorporation of external AC power supply connections into connectors of the type otherwise described herein can be achieved for a wide variety of connector housings, such as the right angle power connectors and the vertical power connectors described herein.

A retention mechanism for retaining the AC power spade terminal 416 within the connector housing 402 is shown in FIGS. 30 and 32-33. This form of retention mechanism differs from that shown for the contacts illustrated in FIG. 17, for example, where the retention mechanism is a retention arm 228. For the AC power spade terminal 414 the contact is retained in the connector housing 402 by engagement of a locking bar onto the contact. More specifically, the AC power spade terminal has a gap 462 formed between the rearward arcuate bridging element 422 and opposing tangs 464. When the AC power spade terminals are disposed into position with the connector housing 402 the gaps in each of the corresponding terminals are exposed in a slotted recess 466 in the connector housing such that the gaps 462 across the adjacent spade terminals are aligned with the slotted recess 466. A locking bar 468 of appropriate dimension is positioned into the slotted recess 466 in the connector housing 402 such that the locking bar is seated across the gaps 462 of the spade terminals between the respective rearward arcuate bridging element 422 and the tangs 464 of each spade terminal. In a preferred embodiment as shown in FIG. 30 the locking bar 468 is integrally formed as part of the shroud 438 so that when the shroud is positioned onto the connector housing 402 the locking bar 468 is seated into position in the slotted recess 466. This is not necessary and the locking bar could be a separate piece of plastic material or some other suitable material. The AC power spade terminal is otherwise engaged within the connector housing 402 by a friction fit between the spade terminal and the connector housing. When the locking bar 468 is seated into position within the connector housing 402 engagement of the rearward arcuate bridging element 422 against the locking bar prevents the AC power spade terminal from being pulled out of its engagement within the connector housing.

Another configuration of a power connector incorporating connections for an external AC power supply is shown in FIGS. 38-41. In this embodiment, the connector housing is designed for AC power spade terminals only. In this example, six AC power spade terminals 470, similar to those described previously, are disposed in connector housing 472. Again, the connectors are not intended to be limited to a design for six cable wires and the connector housing can be designed to accommodate any desired number of AC power spade terminals. The top face 473 of the connector housing exposes the opposing side walls of the receptacle end of the AC power spade terminals for mating with an appropriate header or plug connection. The AC power spade terminals are engaged in the connector housing by a friction fit as described previously and are retained in the housing by engagement with a locking bar 474 in the same manner described above. In this embodiment, the locking bar 474 is a separate piece. The connector housing is disposed within opposing halves 476 and 478 of a clamshell cable casing, which cable casing is of the type known in the art. In a preferred embodiment the cable casing is modified to include a groove 480 extending around the perimeter of the casing. A mounting bracket 482, which is affixed to some component structure by the use of screws or the like through holes 484, is designed such that opposing wings 486 and 488 and rail 490 fit into the groove 480. Power connectors of the type described herein float or move with respect to each other when they are mated together due to the design of the post projections 492 and the corresponding post-receiving holes in the mating connector. In order to accommodate the floatable characteristics of the mated power connectors described herein, the mounting bracket is dimensioned such that the wings 486 and 488 and the rail 490 fit loosely within the groove 480. As such, the connector housing 472 can float from side-to-side and forward-to-backward while being otherwise maintained in place by the mounting bracket 482. One of the wings of the mounting bracket can have a cut-out 494 that loosely engages a tab on the connector housing as a polarization feature to ensure proper orientation of the mounting bracket onto the cable casing. Otherwise, the loose fitting nature of the mounting bracket into the groove of the cable casing provides for blind mating of cable connector into the mounting bracket. This is beneficial due to the crowding of various connections in the system, which connections may be at a remote location that is difficult to access for a user.

Figure 42:
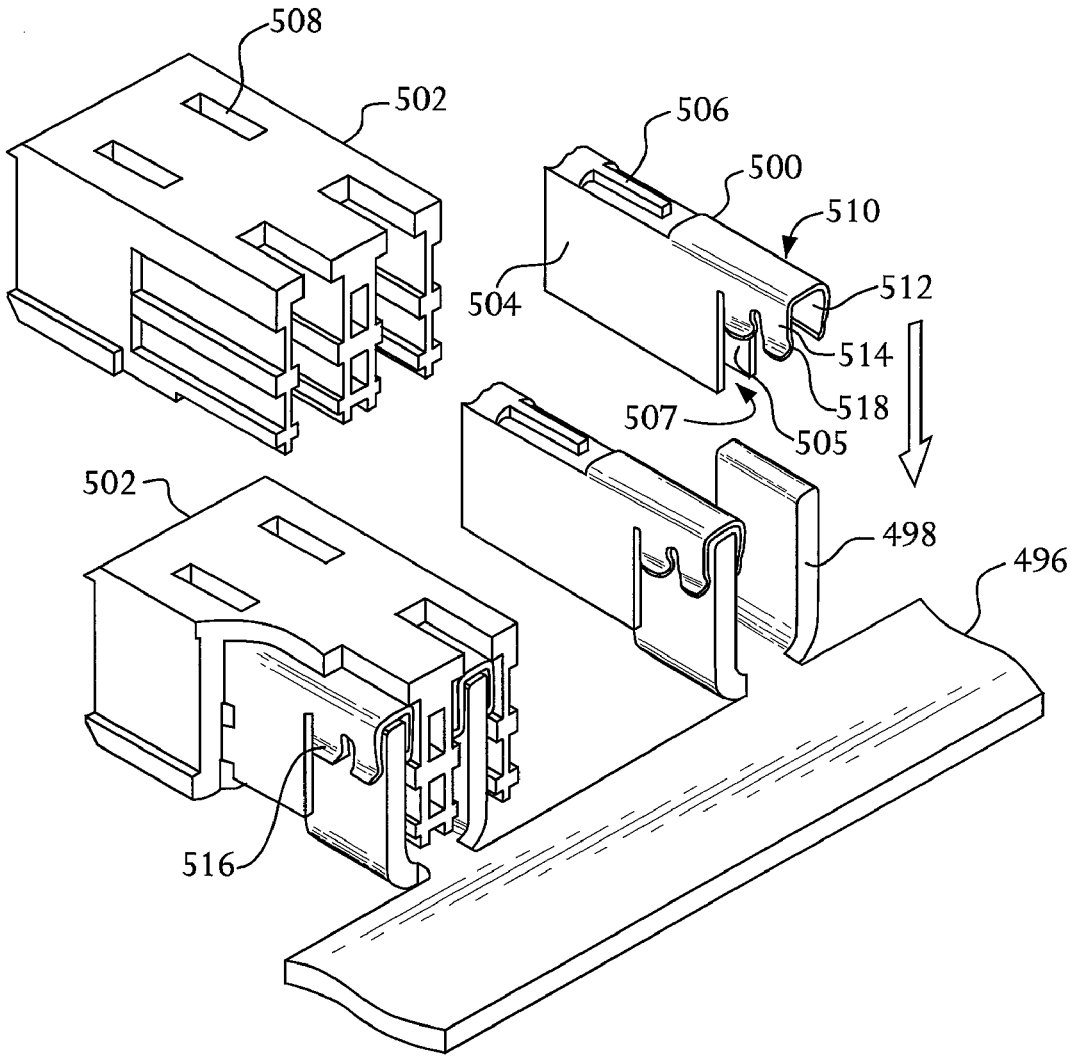
FIG. 42 is a perspective view of a connector incorporating contacts according to a preferred embodiment of the invention for connection to a bus bar.

In some applications, power is supplied to the electronics assembly via conventional bus bars. FIG. 42 shows a connector incorporating a preferred embodiment of new contacts for connection to a bus bar 496 having opposing arms 498 of U-shaped projections. Bus bar terminal contacts 500 are disposed in connector housing 502. The rear portion of the bus bar terminal contacts is similar in many respects to that of the plug contacts 10 and the receptacle contacts 48 shown in FIGS. 1-4 in that the bus bar terminal contacts have two opposed major side walls 504 and 505, which side walls define a medial space 507 adapted for air flow. The bus bar terminal contacts are retained in the housing by the engagement of a spring arm 506 in a slot 508 in the housing. The front portion of the bus bar terminal contacts comprises a clip 510 for engagement onto one of the arms 498 of the U-shaped projections. The clip 510 has two opposing clip side walls 512 and 514, which clip side walls are engaged onto the arm 498. The clip side walls 512 and 514 are bowed slightly in the transverse direction to enhance engagement with the arm 498. Each clip side wall has wing tabs 516 that are joined to the side wall by arcuate elbow 518. The distance between the elbows 518 of the opposing side walls is slightly less than the thickness of the arm 498 such that the elbows create an inward force on the arms when the clip 510 is engaged onto the arm.

The bus bar terminal contacts described herein can be used in any connector for engagement of bus bars and are not intended to be limited for use in the connector housing configuration illustrated herein. For example, any of the receptacle connectors described herein can be modified to accommodate incorporation of bus bar terminal contacts for mating the power connectors herein with bus bars.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed:

1. An electrical connector, comprising:

a connector housing including a mating side that engages a complementary electrical connector; and a receptacle power contact retained in the connector housing, the receptacle power contact including: opposed first and second side walls extending in a first direction at the mating side, a medial space defined between the opposed first and second side walls defining a plug contact receiving space, and an extension defined by cantilevered beams that extend in a second direction that is different than the first direction and that is away from the mating side of the connector housing such that the cantilevered beams do not engage the complementary electrical connector, wherein the cantilevered beams define opposing arcs along the second direction to provide a spring-like effect when received in a connector terminal, wherein the cantilevered beams define respective opposing proximal and distal ends that are each in contact with each other, and the arcs are disposed along the second direction between the proximal and distal ends.

2. An electrical connector, comprising:

a connector housing including a mating end that engages a complementary electrical connector, and a second end that is different from the mating end, wherein the connector housing terminates at the second end;

at least one AC power contact partially disposed in the connector housing, the at least one AC power contact including: opposed first and second side walls, a medial space defined between the opposed first and second side walls, and a cable plug projection extending from the opposed first and second side walls and beyond the second end of the connector housing so as to be received by a socket of an AC power cable; and a shroud that is connected to the connector housing and covers the cable plug projection.

3. The electrical connector of claim 2 wherein the at least one AC power contact is devoid of any printed circuit structure engaging features.

4. The electrical connector of claim 2 wherein the cable plug projection comprises opposed cantilevered beams, each of which extend from a respective one of the opposed first and second side walls.

5. The electrical connector of claim 4, wherein the opposed cantilevered beams are spaced closely together.

6. The electrical connector of claim 4, wherein each of the opposed cantilevered beams includes an arcuate section.

7. The electrical connector of claim 6 wherein the arcuate sections impart a spring-like effect to the socket when received by the socket.

8. The electrical connector of claim 7, wherein each beam presents a convex surface with respect to the other beam.

9. The electrical connector of claim 4 wherein the cantilevered beams extend beyond a periphery of the connector housing.

10. The electrical connector of claim 2 wherein the socket is a quick connect socket.

11. The electrical connector of claim 2 wherein the connector housing also terminates at the mating end.

12. The electrical connector of claim 2, wherein the shroud is removably connected to the connector housing.

* * * * *